US008606122B2

(12) United States Patent
Nagamine

(10) Patent No.: US 8,606,122 B2
(45) Date of Patent: Dec. 10, 2013

(54) IMAGE FORMING APPARATUS WITH A FIXING UNIT

(75) Inventor: Kiyoshi Nagamine, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 378 days.

(21) Appl. No.: 12/899,745

(22) Filed: Oct. 7, 2010

(65) Prior Publication Data

US 2011/0236036 A1 Sep. 29, 2011

(30) Foreign Application Priority Data

Mar. 26, 2010 (JP) ..... 2010-071793

(51) Int. Cl.
*G03G 15/00* (2006.01)

(52) U.S. Cl.
USPC ..... 399/12

(58) Field of Classification Search
USPC ..... 399/9, 12, 24, 25, 27–30, 38, 61–64, 399/67–70
See application file for complete search history.

(56) References Cited

U.S. PATENT DOCUMENTS 6,674,978 B1 * 1/2004 Suzuki et al. ..... 399/67
7,945,096 B2 * 5/2011 Okada ..... 382/181

FOREIGN PATENT DOCUMENTS

JP 05281874 A 10/1993
JP 07191564 A 7/1995
JP 08248810 A 9/1996
JP 11015331 A 1/1999
JP 2005352401 A 12/2005
JP 2007304186 A 11/2007

OTHER PUBLICATIONS

MultiWriter 5750C Color Laser Printer Application Manual, NEC Corporation, 1st Edition: Oct. 2008.

* cited by examiner

*Primary Examiner* — Hoan Tran
(74) *Attorney, Agent, or Firm* — Sughrue Mion, PLLC

(57) ABSTRACT

An image forming apparatus includes a fixing unit which fixes an unfixed toner image retained onto a recording medium by at least heat while moving the recording medium; a setting unit which sets a plurality of levels of fixing condition in the fixing unit in accordance with user's desire; and a changing unit which changes at least one of temperature with which the recording medium is heated by the fixing unit and speed with which the recording medium is moved by the fixing unit, in accordance with the level of fixing condition set by the setting unit.

16 Claims, 22 Drawing Sheets

SETTING TABLE FOR STANDARD SHEET

| FIXING LEVEL | FIXING SPEED | FIXING TEMPERATURE |
|---|---|---|
| 15 | 4 | 5 |
| 14 | 4 | 4 |
| 13 | 4 | 3 |
| 12 | 4 | 2 |
| 11 | 4 | 1 |
| 10 | 2 | 5 |
| 9 | 2 | 4 |
| 8 | 2 | 3 |
| 7 | 2 | 2 |
| 6 | 2 | 1 |
| 5 | 1 | 5 |
| 4 | 1 | 4 |
| 3 | 1 | 3 |
| 2 | 1 | 2 |
| 1 | 1 | 1 |

SETTING TABLE FOR CARDBOARD

| FIXING LEVEL | FIXING SPEED | FIXING TEMPERATURE |
|---|---|---|
| 15 | 5 | 5 |
| 14 | 5 | 4 |
| 13 | 5 | 3 |
| 12 | 5 | 2 |
| 11 | 5 | 1 |
| 10 | 3 | 5 |
| 9 | 3 | 4 |
| 8 | 3 | 3 |
| 7 | 3 | 2 |
| 6 | 3 | 1 |
| 5 | 2 | 5 |
| 4 | 2 | 4 |
| 3 | 2 | 3 |
| 2 | 2 | 2 |
| 1 | 2 | 1 |

NVM LIST

HIGHER IN FIXING LEVEL

SPEED SETTING TABLE

| | FIXING SPEED |
|---|---|
| 5 | X 0.25 |
| 4 | X 0.50 |
| 3 | X 0.75 |
| 2 | STANDARD IMAGE FORMING SPEED |
| 1 | X 1.25 |

TEMPERATURE SETTING TABLE

| | FIXING TEMPERATURE |
|---|---|
| 5 | + 30°C |
| 4 | + 20°C |
| 3 | + 10°C |
| 2 | DEFAULT TEMPERATURE |
| 1 | −10°C |

(CONT.)

(FIG. 15 CONTINUED)
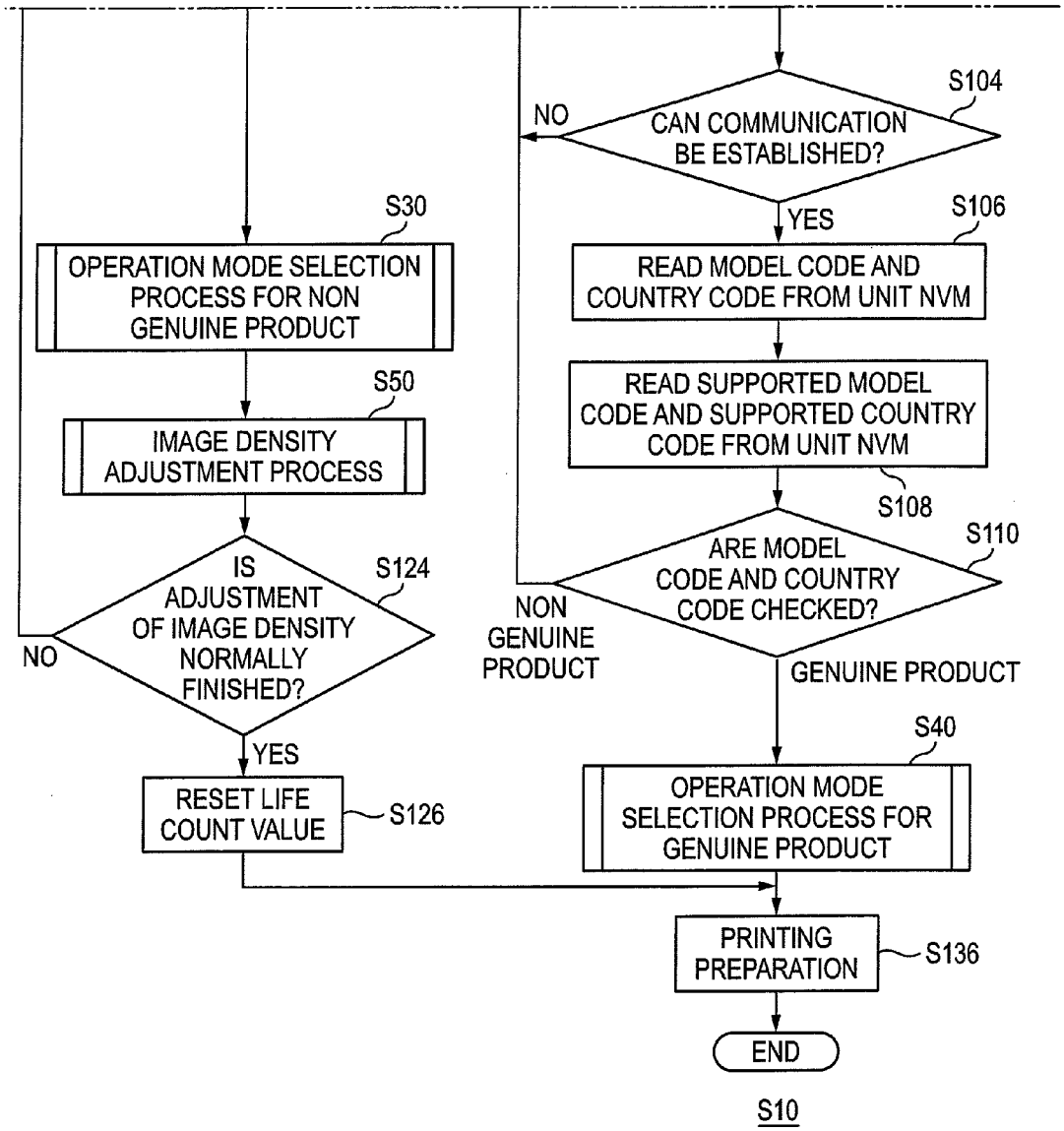

IMAGE FORMING APPARATUS WITH A FIXING UNIT

CROSS-REFERENCE TO RELATED APPLICATION

This application is based on and claims priority under 35 USC 119 from Japanese Patent Application No. 2010-071793 filed on Mar. 26, 2010.

BACKGROUND

1. Technical Field

The present invention relates to an image forming apparatus.

2. Related Art

An image forming apparatus has heretofore the following configuration. That is, a toner image in accordance with image information is formed on an image retainer, and the toner image formed on the image retainer is transferred directly onto a recording sheet and fixed by a fixing unit. Alternatively, a toner image formed on an image retainer is once primarily transferred onto an intermediate transferor, then secondarily transferred onto a recording sheet from the intermediate transferor, and fixed by a fixing unit. Thus, a monochrome or full-color image is formed.

Toner used in the image forming apparatus on that occasion is typically provided by a manufacturer of the image forming apparatus. However, the toner may be provided by a maker other than the manufacturer of the image forming apparatus. In this case, when an unfixed toner image transferred onto a recording sheet is fixed by the fixing unit, the fixability of the toner may be different from fixability set originally in the image forming apparatus, so that a desired quality of fixation cannot be always obtained.

SUMMARY

According to an aspect of the invention, an image forming apparatus includes:

a fixing unit which fixes an unfixed toner image retained onto a recording medium by at least heat while moving the recording medium;

a setting unit which sets a plurality of levels of fixing condition in the fixing unit in accordance with user's desire; and a changing unit which changes at least one of temperature with which the recording medium is heated by the fixing unit and speed with which the recording medium is moved by the fixing unit, in accordance with the level of fixing ability set by the setting unit.

BRIEF DESCRIPTION OF THE DRAWINGS

Exemplary embodiments of the invention will be described in detail based on the following figures, wherein.

DETAILED DESCRIPTION

An exemplary embodiment of the invention will be described below with reference to the drawings.

First Exemplary Embodiment

Figure 2:
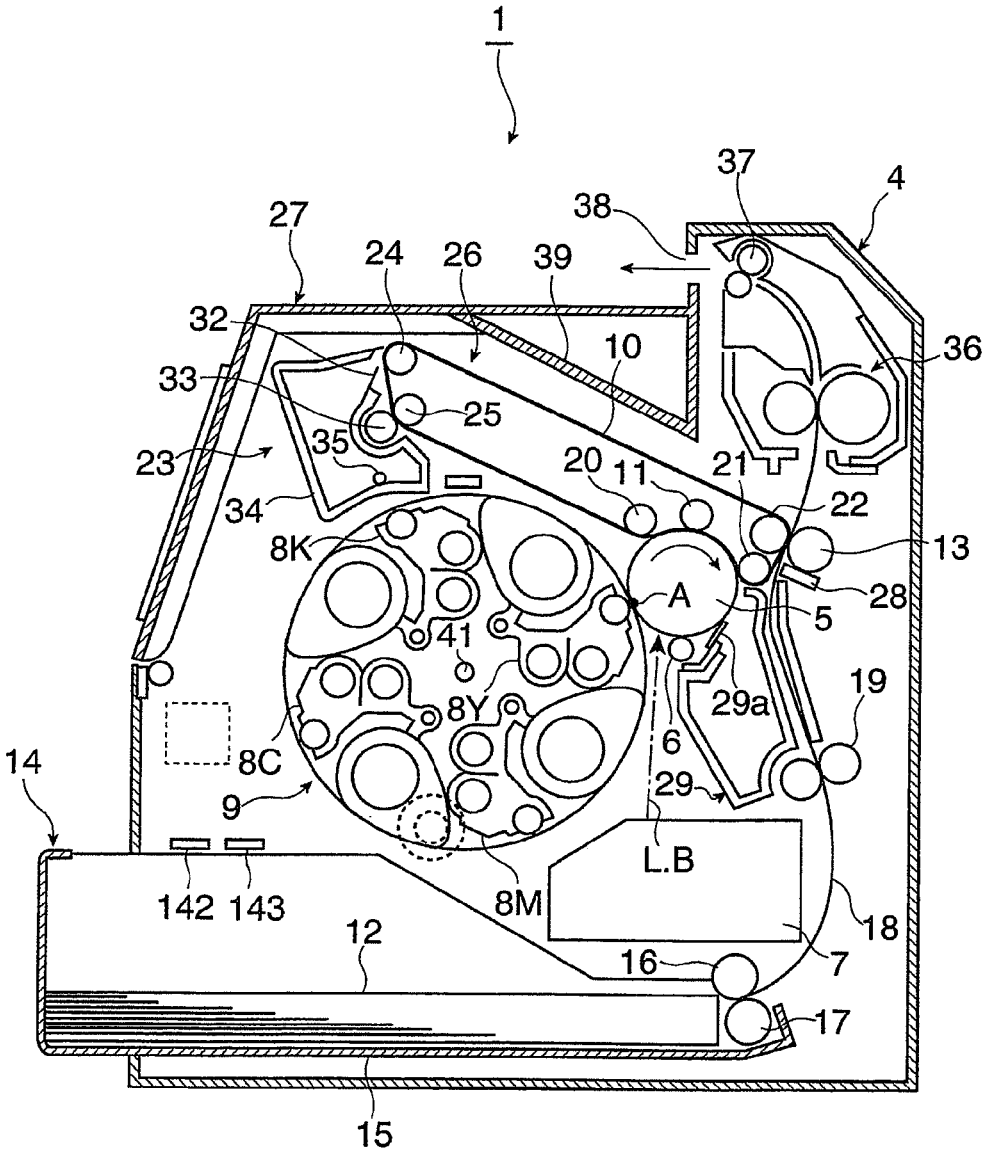
FIG. 2 is a configuration view showing the full-color printer as the image forming apparatus according to the first exemplary embodiment of the invention.

FIG. 2 is a schematic configuration view showing a so-called four-cycle type digital color printer as an image forming apparatus according to a first exemplary embodiment of the invention.

Figure 3:
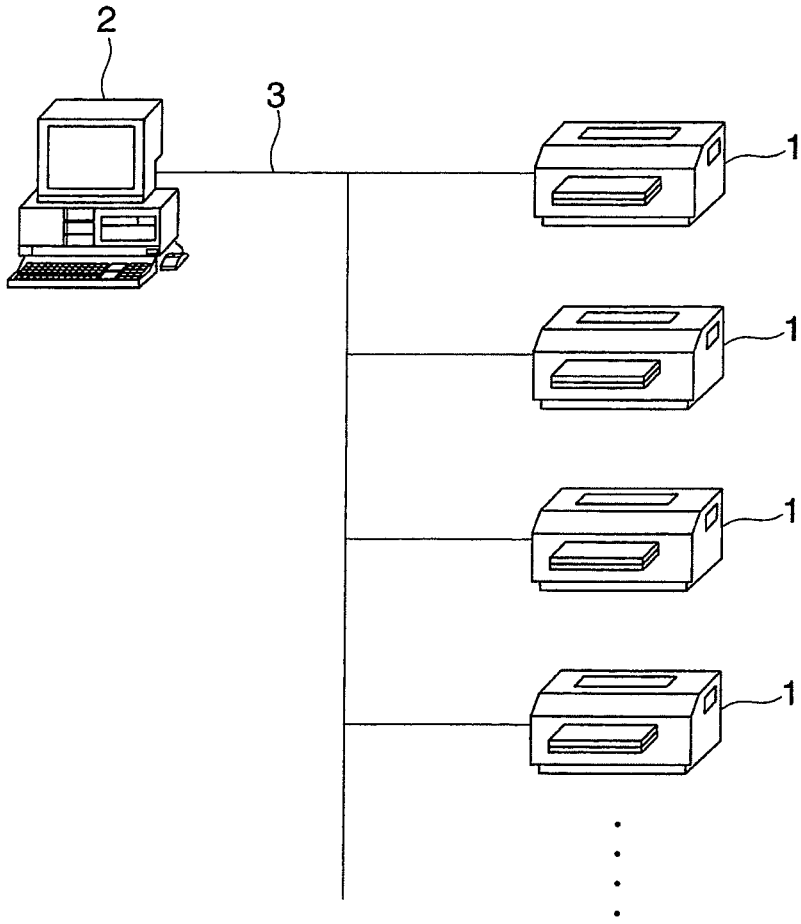
FIG. 3 is a configuration view showing a network to which full-color printers are connected.

In FIG. 2, the reference numeral 1 represents a digital color printer. For example, as shown in FIG. 3, the digital color printer 1 is connected to a host apparatus 2 constituted by a personal computer or the like through a network 3. The digital color printer 1 prints a full-color or monochrome image based on image data sent from the host apparatus 2 or image data sent from a not-shown image reading apparatus or through a communication line such as a phone line.

Figure 4:
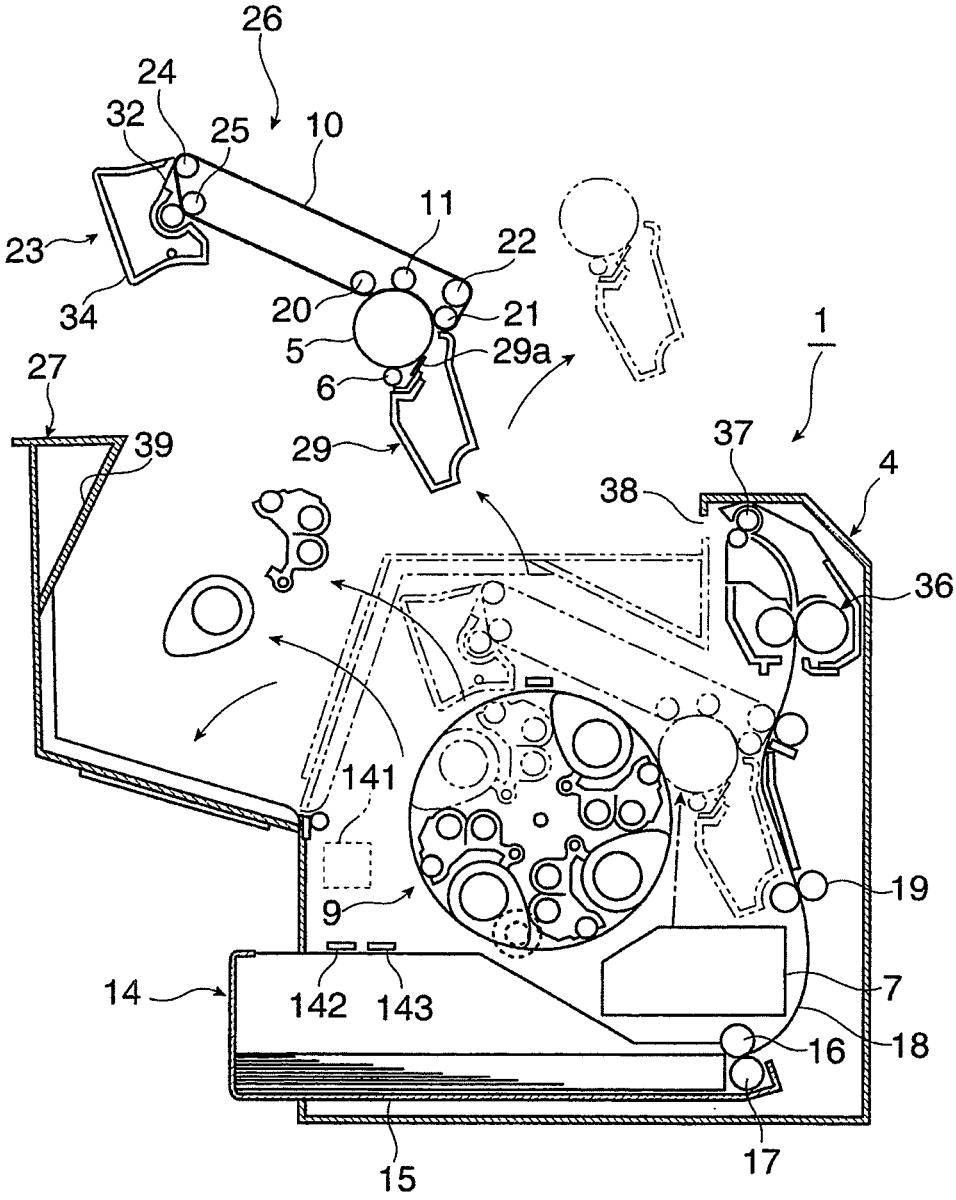
FIG. 4 is a configuration view showing the full-color printer as the image forming apparatus according to the first exemplary embodiment of the invention, in a state in which a replacement cover has been opened to remove an image forming unit.

Inside a body 4 of the digital color printer 1, a photoconductor drum 5 as an image retainer is rotatably disposed slightly more closely to an upper right portion than the center, as shown in FIG. 4. For example, a conductive cylinder which is coated with a photoconductor layer made of OPC or the like and which has a diameter of about 47 mm is used as the photoconductor drum 5. The photoconductor drum 5 is rotationally driven at a process speed of about 150 mm/sec in the arrow direction by a not-shown drive unit. The surface of the photoconductor drum 5 is charged to predetermined potential by a charging roll 6 which serves as a charging unit disposed substantially just under the photoconductor drum 5. After that, the surface of the photoconductor drum 5 is exposed to a laser beam (LB) with an image by an image exposure unit 7 disposed just under the photoconductor drum 5 and at a distance therefrom. Thus, an electrostatic latent image is formed on the photoconductor drum 5 in accordance with image information. The electrostatic latent image formed on the photoconductor drum 5 is developed by a rotary developing unit 9 where developing units 8Y, 8M, 8C and 8K of respective colors, that is, yellow (Y), magenta (M), cyan (C) and black (K) are disposed circumferentially. Thus, toner images of the respective colors are formed.

On that occasion, respective steps of charging, exposure and developing are repeated on the surface of the photoconductor drum 5 a predetermined number of times in accordance with the color of an image to be formed. In the rotary developing unit 9, one of the developing units 8Y, 8M, 8C and 8K corresponding to a color moves to a developing position A facing the photoconductor drum 5. For example, when a full-color image is formed, the respective steps of charging, exposure and developing are repeated on the surface of the photoconductor drum 5 four times correspondingly to the respective colors (yellow (Y), magenta (M), cyan (C) and black (K)). Thus, toner images corresponding to the respective colors (yellow (Y), magenta (M), cyan (C) and black (K)) are formed on the surface of the photoconductor drum 5 sequentially. The number of turns of the photoconductor drum 5 rotated to form the toner images differs in accordance with the size of the image. For example, when the sheet size is A4, one image can be formed by three turns of the photoconductor drum 5. That is, toner images corresponding to the respective colors (yellow (Y), magenta (M), cyan (C) and black (K)) are formed sequentially on the surface of the photoconductor drum 5 whenever the photoconductor drum 5 turns three times.

The toner images of the respective colors (yellow (Y), magenta (M), cyan (C) and black (K)) formed sequentially on the photoconductor drum 5 are primarily transferred onto an intermediate transfer belt 10 in a primary transfer position by a primary transfer roll 11 so as to be superimposed on one another. The intermediate transfer belt 10 serves as an intermediate transferor and is wound around the outer circumference of the photoconductor drum 5 in the primary transfer position. The toner images of yellow (Y), magenta (M), cyan (C) and black (K) transferred in multiple layers on the intermediate transfer belt 10 are secondarily transferred onto a recording sheet 12 together by a secondary transfer roll 13. The recording sheet 12 is fed at a predetermined timing. From a sheet feed cassette 15 of a sheet feed unit 14 disposed in a lower portion of the full-color printer body 4, one recording sheet 12 is fed out by a pickup roll 16 and separated from another by a retard roll 17. The recording sheet 12 supplied thus is conveyed through a sheet conveyance path 18 to a secondary transfer position on the intermediate transfer belt 10 by a registration roll 19 in sync with the toner images transferred onto the intermediate transfer belt 10.

The intermediate transfer belt 10 is stretched by a plurality of rolls and driven, for example, in accordance with rotation of the photoconductor drum 5, so as to cyclically move at a predetermined process speed (about 150 mm/sec). The intermediate transfer belt 10 is stretched with a predetermined tension by a winding entrance roll 20, the primary transfer roll 11, a winding exit roll 21, a back support roll 22, a first cleaning back support roll 24 and a second cleaning back support roll 25. The winding entrance roll 20 specifies the winding position of the intermediate transfer belt 10 on the rotationally upstream side of the photoconductor drum 5. The primary transfer roll 11 transfers toner images formed on the photoconductor drum 5 onto the intermediate transfer roll 10. The winding exit roll 21 specifies the winding position of the intermediate transfer belt 10 on the downstream side of the winding position. The back support roll 22 is brought into contact with the secondary transfer roll 13 through the intermediate transfer belt 10. The first and second cleaning back support rolls 24 face a cleaning unit 23 for the intermediate transfer belt 10.

In addition, the intermediate transfer belt 10 is stretched by the rolls 11, 20-22, 24 and 25 as described above. In this exemplary embodiment, in order to miniaturize the full-color printer body 4, the sectional shape with which the intermediate transfer belt 10 is stretched is formed into an approximately trapezoidal shape which is flat, long and narrow.

In this exemplary embodiment, as shown in FIG. 2, the full-color printer as a whole is made as small as possible. The rotary developing unit 9 occupies a large space in the full-color printer body 4. Therefore, the full-color printer body 4 is designed to improve maintainability of the intermediate transfer belt 10, the rotary developing unit 9, etc. while miniaturizing the apparatus. Specifically, the intermediate transfer belt 10 forms an image forming unit 26 integrally with the photoconductor drum 5, the charging roll 6, etc. When a top cover 27 serving as a replacement cover of the full-color printer body 4 and ranging from its top to its side is opened, the image forming unit 26 as a whole can be attached to and detached from the full-color printer body 4. A density sensor 28 is disposed on the side of the intermediate transfer belt 10 located on the upstream side of the secondary transfer position. The density sensor 28 is made of a reflection type photosensor for detecting a toner patch or the like formed on the intermediate transfer belt 10.

Figure 5:
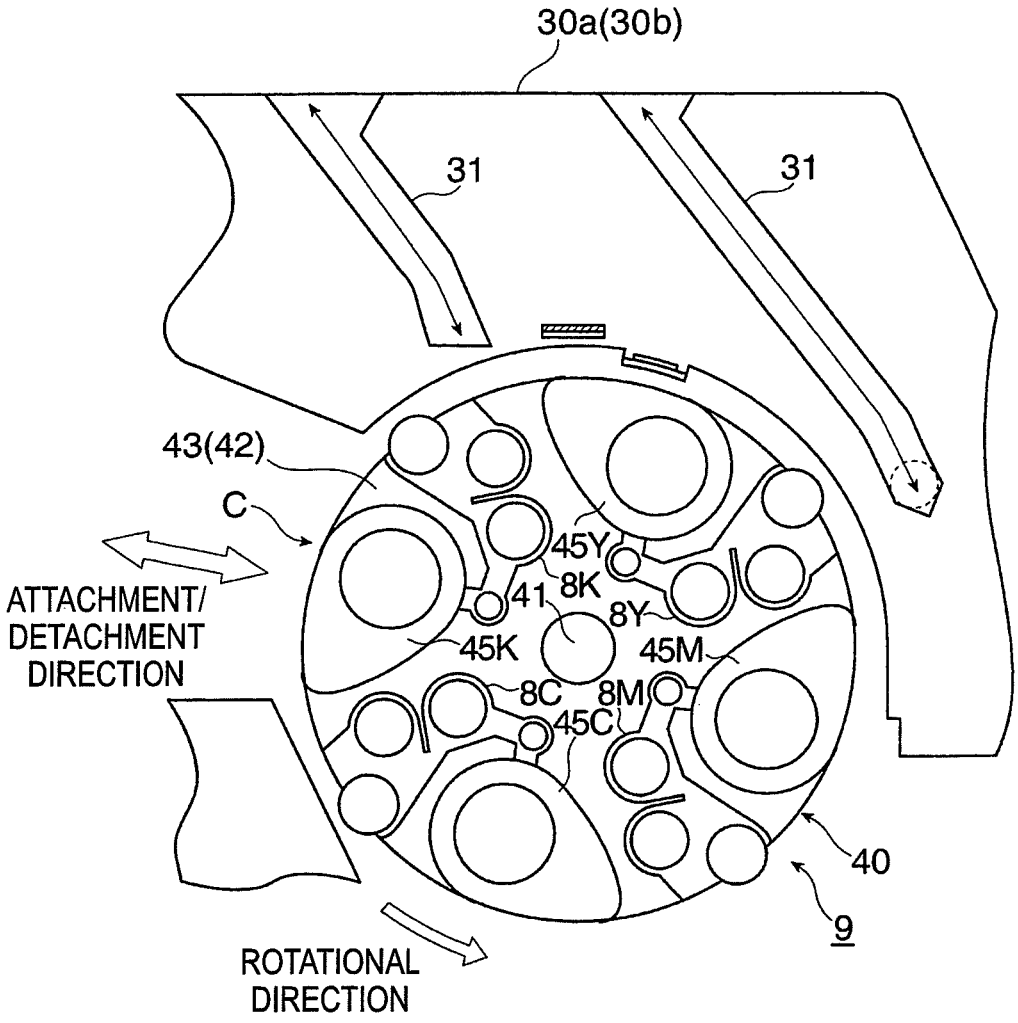
FIG. 5 is a configuration view showing an attachment/detachment mechanism for the image forming unit.

As shown in FIG. 4, the photoconductor drum 5, the charging roll 6, the intermediate transfer belt 10, the rolls 11, 20-22, 24 and 25 stretching the intermediate transfer belt 10, the cleaning unit 23 for the intermediate transfer belt 10, and a cleaning unit 29 for the photoconductor drum 5 are mounted integrally in the image forming unit 26. The cleaning unit 29 will be described later. As shown in FIG. 4, the image forming unit 26 can be removed from the printer body 4 when the image forming unit 26 is lifted up with a hand on a not-shown grip. In addition, internal frames 30*a* and 30*b* are disposed in parallel to each other on the front and rear sides of the printer body 4. As shown in FIG. 5, two guide grooves 31*a* and 31*b* for guiding the image forming unit 26 when the image forming unit 26 is attached or detached are provided in the internal frames 30*a* and 30*b* respectively. Further, as shown in FIG. 2, the image forming unit 26 is disposed along and closely to the rotationally outer circumference of the rotary developing unit 9 so as to range from the cleaning unit 23 for the intermediate transfer belt 10 to the photoconductor drum 5 in order to make the printer body 4 as small as possible.

Furthermore, in a range of the printer body 4 from its top to its side, as shown in FIG. 2, the top cover 27 serving as a replacement cover is provided so that the image forming unit 26 can be attached and detached, as described above. As shown in FIG. 4, when the top cover 27 is opened, the image forming unit 26 is exposed. Thus, as shown in FIG. 5, the image forming unit 26 can be removed from the printer body 4 if the image forming unit 26 is lifted up along the two guide grooves 31*a* and 31*b* with a hand on a not-shown grip. On the contrary, in order to attach the image forming unit 26 to the printer body 4, inversely to the case where the image forming unit 26 is removed, the image forming unit 26 is held with a hand on the grip and lifted down gradually so that parts of the image forming unit 26 can be fitted into the two guide grooves 31*a* and 31*b*. Thus, as shown in FIG. 4, the image forming unit 26 can be mounted in a predetermined position of the printer body 4.

In addition, the cleaning unit 23 for the intermediate transfer belt 10 has a scraper 32 and a cleaning brush 33 as shown in FIG. 2. The scraper 32 is disposed in contact with the surface of the intermediate transfer belt 10 stretched by the first cleaning back support roll 24. The cleaning brush 33 is disposed in pressure contact with the surface of the intermediate transfer belt 10 stretched by the second cleaning back support roll 25. Residual toner or paper dust removed by the scraper 32 or the cleaning brush 33 is recovered into a unit body 34 of the cleaning unit 23. The unit body 34 of the cleaning unit 23 is disposed swingably counterclockwise in FIG. 2 and around a swinging shaft 35. The unit body 34 is retreated at a distance from the surface of the intermediate transfer belt 10 till the secondary transfer of a toner image of a final color is completed. As soon as the secondary transfer of the toner image of the final color is completed, the unit body 34 is brought into contact with the surface of the intermediate transfer belt 10.

Further, the recording sheet 12 to which the toner images have been transferred from the intermediate transfer belt 10 is conveyed to a fixing unit 36 serving as a fixing unit as shown in FIG. 2. The toner images are fixed onto the recording sheet 12 by heat and pressure applied by the fixing unit 36. The recording sheet 12 is discharged from an output port 38 onto an output tray 39 provided in the top portion of the printer body 4 by an output roll 37.

From the surface of the photoconductor drum 5 where the toner image transfer step has been completed, residual toner etc. is removed by a cleaning blade 29*a* of the cleaning unit 29 disposed obliquely under the photoconductor drum 5 whenever the photoconductor drum 5 turns 360 degrees. Thus, the photoconductor drum 5 can get ready for the next image forming step.

Figure 6:
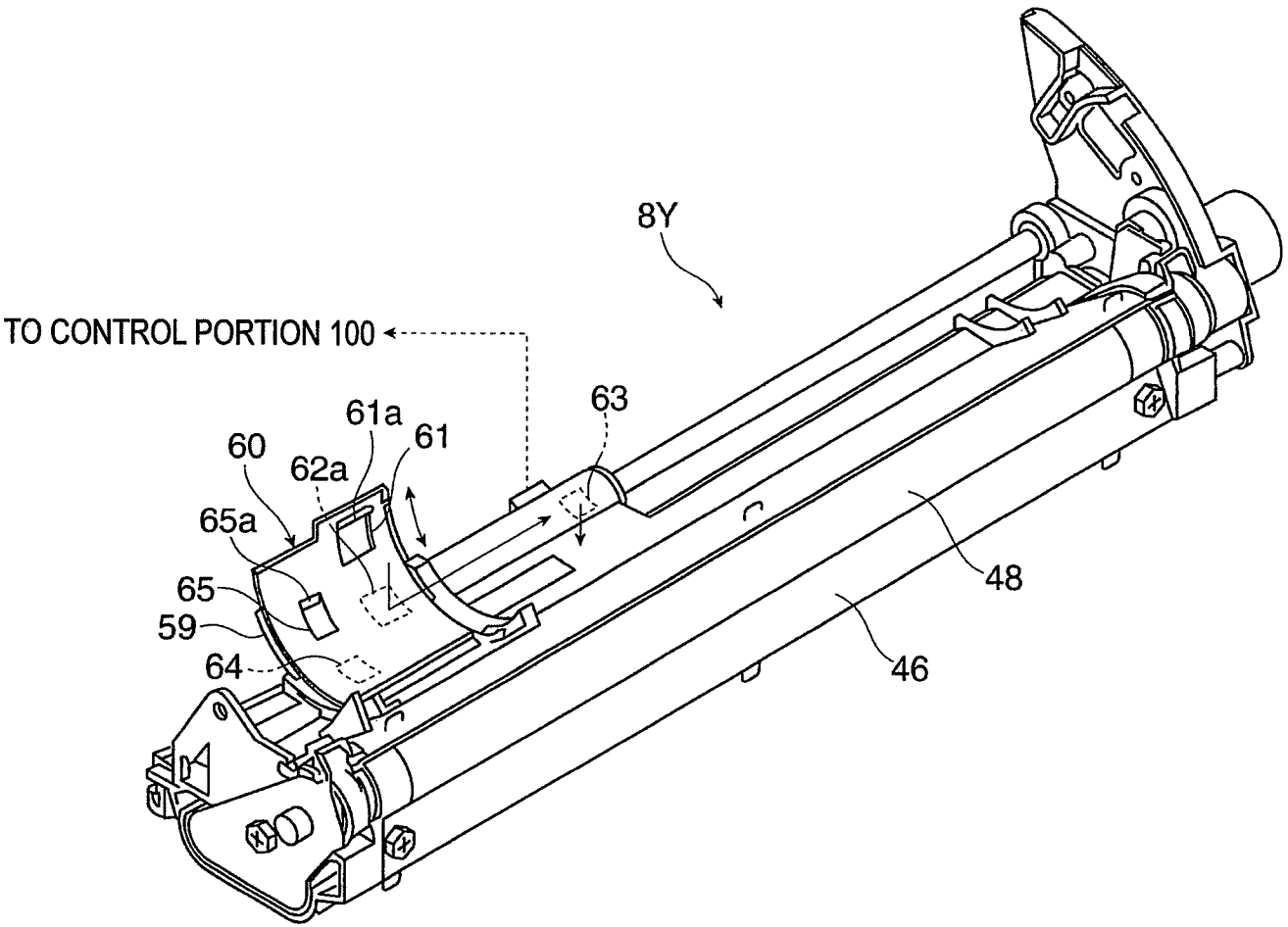
FIG. 6 is a perspective configuration view showing a developing unit mounted on a rotary developing unit which is applied to the image forming apparatus according to the exemplary embodiment.
Figure 7:
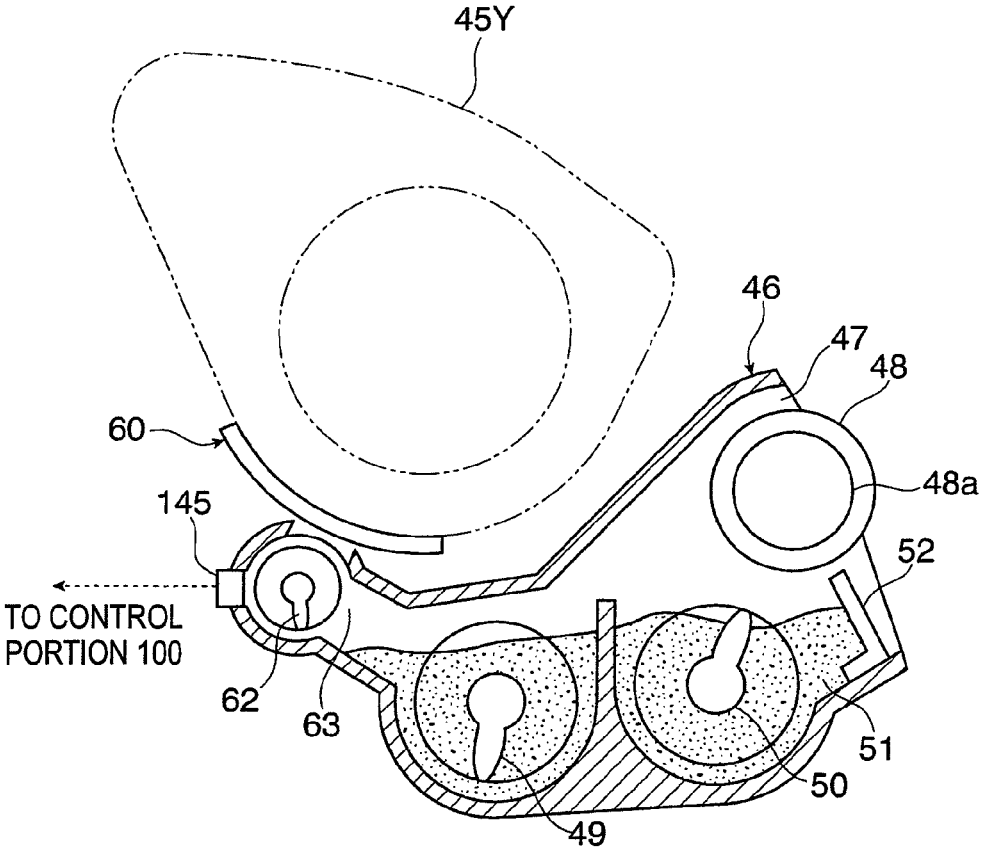
FIG. 7 is a schematic sectional view showing the developing unit which is applied to the image forming apparatus according to the exemplary embodiment.

FIG. 6 is a perspective configuration view showing a developing unit 8 mounted on the rotary developing unit applied to the image forming apparatus according to the exemplary embodiment. FIG. 7 is a schematically sectional view showing the developing unit 8 applied to the image forming apparatus according to the exemplary embodiment.

As shown in FIG. 5, the rotary developing unit 9 has a developing unit body 40 which is rotatably disposed within a plane extending in a vertical direction. The developing unit body 40 has a cylindrical rotating shaft member 41, a front-side flange member 42, a rear-side flange member 43, and a not-shown partition member. The rotating shaft member 41 is disposed in the central portion of the developing unit body 40 so as to extend in the longitudinal direction thereof. The front-side flange member 42 is disposed in the longitudinally near-side end portion of the rotating shaft member 41. The rear-side flange member 43 is disposed in the longitudinally distant end portion of the rotating shaft member 41. The partition member partitions a cylindrical space S into four on a 90-degree basis. The space S is formed by the rotating shaft member 41 and the front-side and rear-side flange members 42 and 43.

As shown in FIG. 2, the developing unit body 40 is attached to the printer body 4 rotatably counterclockwise around the rotating shaft member 41. As shown in FIG. 5, four developing units 8Y, 8M, 8C and 8K for yellow (Y), magenta (M), cyan (C) and black (K) are mounted circumferentially clockwise in the developing unit body 40. In addition, four developing agent cartridges (hereinafter also referred to as "toner cartridges") 45Y, 45M, 45C and 45K for yellow (Y), magenta (M), cyan (C) and black (K) are mounted circumferentially correspondingly to the developing units 8Y, 8M, 8C and 8K.

All these developing units 8Y, 8M, 8C and 8K are configured in the same manner. Therefore, the yellow (Y) developing unit 8Y will be described here as an example. The yellow (Y) developing unit 8Y has a developing unit body 46 as shown in FIG. 6. To the developing unit body 46, a fresh developing agent containing at least toner is supplied from the corresponding developing agent cartridge 45Y through a supply port 62*a* of a developing agent supply portion 59 formed into an arc shape.

As shown in FIG. 7, a developing roll 48 and two spiral augers 49 and 50 are provided inside the developing unit body 46. The developing roll 48 is disposed so that a part of the developing roll 48 is exposed in an opening portion 47 which is provided to face the outer circumference of the developing unit body 46. The developing roll 48 is long in the perpendicular direction to the paper surface of FIG. 7. The spiral augers 49 and 50 are located obliquely under and behind the developing roll 48 so as to extend in parallel to the developing roll 48. The developing roll 48 is disposed almost all over the length of the developing unit body 46 as shown in FIG. 6. In the developing unit 8Y, as shown in FIG. 7, when the developing roll 48 is rotated, a developing agent 51 received in the developing unit body 46 is stirred and conveyed in one direction perpendicular to the paper surface of FIG. 7 by the distant-side spiral auger 49. On the other hand, the spiral auger 50 stirs and conveys the developing agent 51 in a reverse direction to the conveyance direction of the spiral auger 49. Thus, the developing agent 51 is uniformly supplied to the developing roll 48. The developing agent 51 supplied to the surface of the developing roll 48 is controlled in terms of layer thickness by a layer thickness control member 52 and conveyed to a developing region facing the photoconductor drum 5 in accordance with the rotation of the developing roll 48. Although two-component developing agent containing toner and carrier is used as the developing agent 51 in this exemplary embodiment, any developing agent may be used as the developing agent 51 as long as the developing agent contains at least toner. Not to say, a one-component developing agent containing only toner may be used.

As shown in FIG. 7, the developing roll 48 magnetically attracts the carrier contained in the developing agent 51 by means of a magnet roll 48*a* which is disposed to be internally fixed in the developing roll 48. Thus, a magnetic brush of the developing agent 51 is formed on the surface of the developing roll 48 so that the toner attracted by the carrier can be conveyed to a developing area which faces the photoconductor drum 5. Then, an electrostatic latent image formed on the photoconductor drum 5 is developed by the magnetic brush of the developing agent 51 containing the carrier and the toner and formed on the surface of the developing roll 48.

Figure 8:
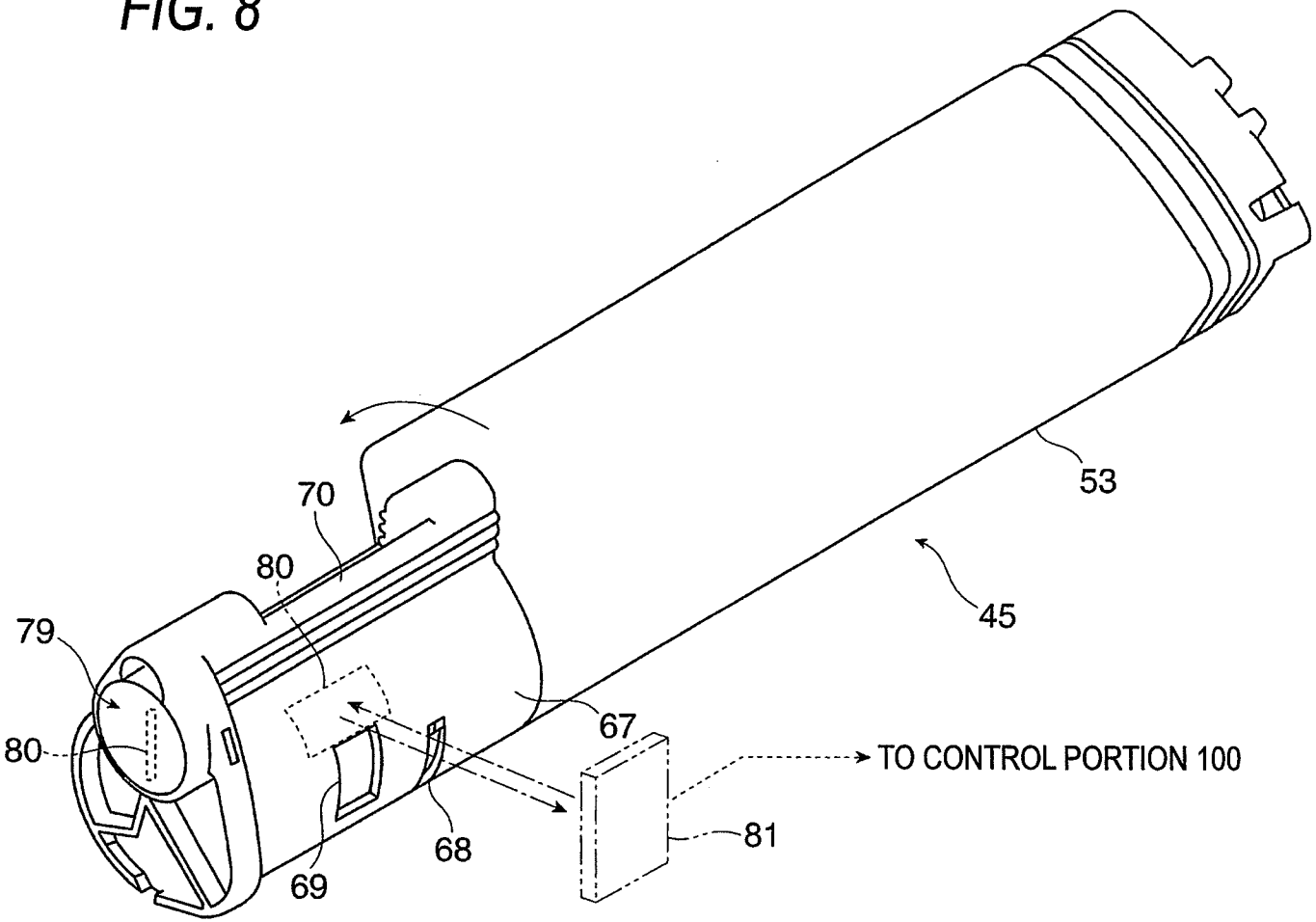
FIG. 8 is a perspective configuration view showing a developing agent cartridge.
Figure 9:
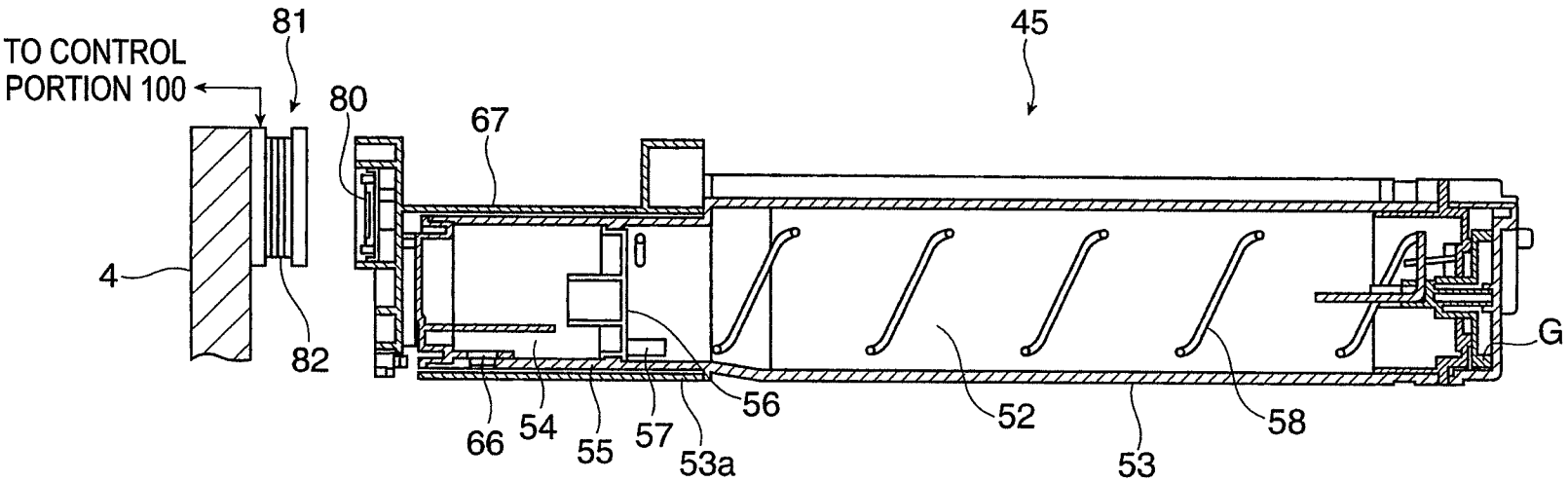
FIG. 9 is a sectional configuration view showing the developing agent cartridge.

As shown in FIG. 8, the developing agent cartridge 45 is made of a noncircular long and cylindrical vessel whose sectional shape is hardly circular. As shown in FIG. 9, the inside of the developing agent cartridge 45 is sectioned into a developing agent receiving portion 53 and a developing agent recovering portion 55 by a partitioning cap 56. The developing agent receiving portion 53 receives a fresh developing agent 51. The developing agent recovering portion 55 recovers a used developing agent 54. In this exemplary embodiment, setting is made so that the developing agent receiving portion 53 occupies about 4/5 of the whole length of the developing agent cartridge 45 and the developing agent recovering portion 55 occupies about ⅕ of the same. However, not to say, the ratio between the length of the developing agent receiving portion 53 and the length of the developing agent recovering portion 55 may be replaced by another ratio.

As shown in FIG. 9, an end portion 53*a* of the developing agent receiving portion 53 close to the developing agent recovering portion 55 is formed to be slightly narrow to be connected to the developing agent recovering portion 55 formed into a cylindrical shape. To this end, the end portion 53*a* of the developing agent receiving portion 53 close to the developing agent recovering portion 55 is formed into the same cylindrical shape as the developing agent recovering portion 55. In the cylindrical portion 53*a* of the developing agent receiving portion 53, as shown in FIG. 9, a supply port 57 for supplying a fresh developing agent 51 to the outside is opened like a rectangular shape in a slightly inclined position of the end portion close to the developing agent recovering portion 55. In addition, a spiral agitator 58 is rotatably disposed inside the developing agent receiving portion 53. The agitator 58 stirs and conveys the fresh developing agent 51 received inside the developing agent receiving portion 53. The developing agent 51 is conveyed and supplied to the outside through the supply port 57 by the agitator 58. In the rear-side end portion of the developing agent cartridge 45, a gear G for rotationally driving the agitator 58 is provided to be partially exposed to the outside. When the developing agent cartridge 45 is attached to the developing unit body 46, the gear G engages with a not-shown gear provided in the developing unit body 46 to rotationally drive the agitator 58.

In the developing unit 8Y to which the developing agent 51 is supplied from the developing agent cartridge 45, a developing-unit-side shutter plate 60 in contact with a portion of the developing agent cartridge 45 corresponding to the supply port 57 is provided to be curved substantially like an arc as shown in FIG. 6. The shutter plate 60 is attached to the developing agent supply portion 59 of the developing unit body 46 slidably in the arrow direction. In addition, a supply reception port 61 for receiving the fresh developing agent 51 supplied from the developing agent cartridge 45 is opened in the shutter plate 60, and a protrusion piece 61*a* is provided in the outer-circumferential-side end portion of the supply reception port 61 so as to protrude inward. When the developing agent 51 is supplied from the supply reception port 61 to the developing unit 8Y, the developing agent 51 is conveyed by a predetermined distance in the longitudinal direction of the developing unit body 46 by a supplying auger 62. The supplying auger 62 is disposed over a predetermined length in the back-side upper portion of the developing unit body 46. The supplying auger 62 includes the developing agent supply port 62*a* in its entrance. After that, the developing agent 51 is supplied into the developing unit body 46 through a supplying opening portion 63 provided in the back-side upper portion of the developing unit body 46.

Further, in the developing unit 8Y, as shown in FIG. 6, a recovering opening portion 64 is provided in the back-side upper portion of the developing unit body 46 so as to recover the used developing agent of the developing agent 51 received inside the developing unit body 46. When the developing unit 8Y is rotated to move to a position C in FIG. 5, a not-shown flap is opened to recover a part of the used developing agent 54. The used developing agent 54 recovered from the developing unit 8Y is recovered into the developing agent recovering portion 55 of the developing agent cartridge 45 through a recovering discharge port 65 and a recovery port 66. The recovering discharge port 65 is opened in the shutter plate 60 as shown in FIG. 6. The recovery port 66 is opened in the developing agent cartridge 45 as shown in FIG. 9. A protrusion piece 65*a* is also provided in the recovering discharge port 65 of the developing unit 8Y so as to protrude inward as shown in FIG. 6.

In this exemplary embodiment, as shown in FIGS. 8 and 9, a shutter member 67 is fitted to the cylindrically shaped outer circumferences of the developing agent receiving portion 53 and the developing agent recovering portion 55 of the developing agent cartridge 45 so that the shutter member 67 can rotate in the circumferential direction. The shutter member 67 serves as an opening/closing member for opening/closing the support port 57 of the developing agent receiving portion 53 and the recovery port 66 of the developing agent recovering portion 55. The shutter member 67 is formed into a cylindrical shape in the same manner as the developing agent receiving portion 53 and the developing agent recovering portion 55 of the developing agent cartridge 45. However, the shutter member 67 is formed to have an inner diameter slightly larger than the outer diameter of the developing agent recovering portion 55 and have a circular shape which can substantially internally touch a space excluding the developing unit 8Y, of a space allocated to the developing unit 8Y which is one of the developing unit bodies 46 to which the developing agent cartridges 45 should be mounted, as shown in FIG. 5.

In the shutter member 67, as shown in FIGS. 8 and 9, a supplying opening portion 68 and a recovering opening portion 69 are opened in positions corresponding to the supply port 57 and the recovery port 66 of the developing agent cartridge 45. When the shutter member 67 is rotated along the outer circumference of the developing agent recovering portion 55 of the developing agent cartridge 45, the shutter member 67 can open/close the supply port 57 and the recovery port 66 of the developing agent cartridge 45 simultaneously.

As shown in FIG. 8, a grip 70 is provided circumferentially in a portion of the shutter member 67 to protrude toward the outside in the radial direction. The grip 70 is provided for rotationally operating the shutter member 67 and holding the developing agent cartridge 45 to attach the developing agent cartridge 45 to the developing unit body 46.

In addition, in the developing agent cartridge 45, as shown in FIG. 8, a memory chip 80 is attached to a cap 79 or the outer circumferential surface. The cap 79 is provided in an axial end surface of the shutter member 67. The memory chip 80 serves as a memory device which can store information such as the kind of toner in the fresh developing agent received in the developing agent cartridge 45, the use amount of the toner, etc., and which can communicate with the outside. The information stored in the memory chip 80 can be transmitted/received through an antenna 82 of a transmitter/receiver unit 81 provided on the printer body 4 side.

Not only genuine products provided by the manufacturer of the full-color printer but also developing agent cartridges which are non genuine products provided by other manufacturers may be used as the developing agent cartridges 45.

Figure 10:
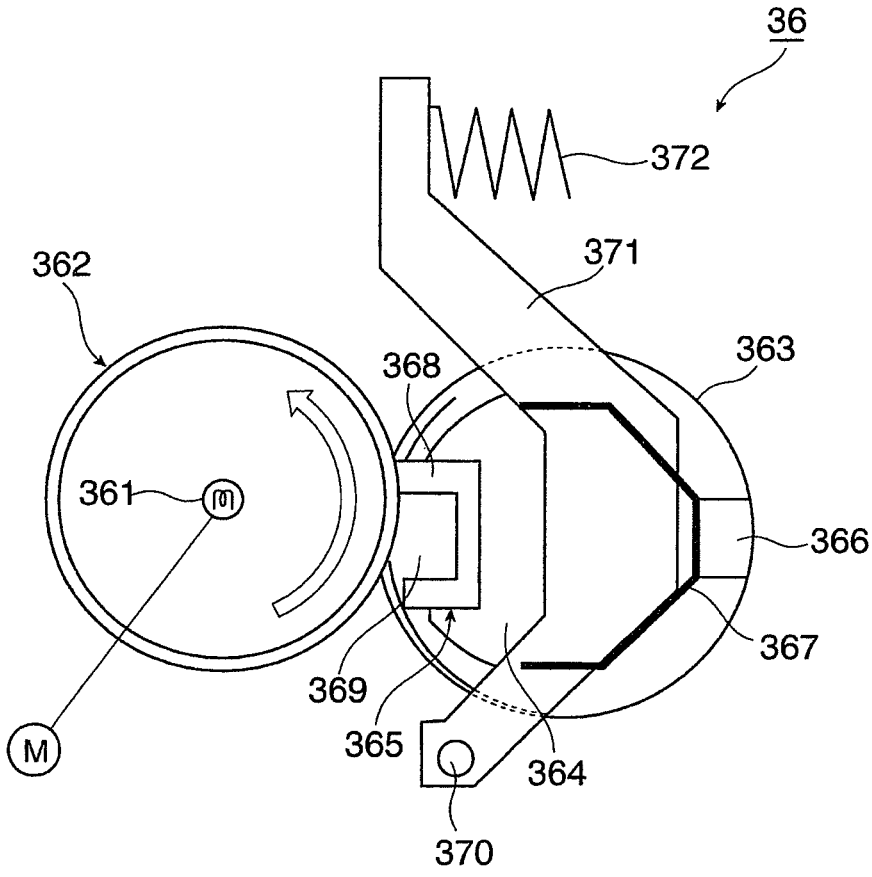
FIG. 10 is a sectional configuration view showing a fixing unit.

FIG. 10 is a schematically sectional view showing a fixing unit of the full-color printer.

The fixing unit 36 according to the exemplary embodiment has a heating roll 362 internally having a heating source 361, a fixing belt 363 shaped like an endless belt, a belt guide member 364, a pressure contact member 365 and a felt member 366 as shown in FIG. 10. The belt guide member 364 supports the opposite ends of the fixing belt 363 so as to allow the fixing belt 363 to rotate desirably. The pressure contact member 365 is disposed inside the fixing belt 363 so as to bring the fixing belt 363 into pressure contact with the surface of the heating roll 362. The felt member 366 serves as an oil supply member for supplying oil to the inner surface of the fixing belt 363.

The heating roll 362 is constituted by a thin cylindrical core, an elastic layer about 0.65 mm thick, and a release layer about 30 μm thick. The core is made from iron, stainless steel or the like. The elastic layer is made from silicon rubber or the like, which is applied to the surface of the core. The release layer is made from PFA or the like, which is applied to the surface of the elastic layer. In addition, a halogen lamp 361 of 600 W as a heating source is disposed inside the heating roll 362. The heating roll 362 can be rotationally driven at a plurality of predetermined speed levels by a driving motor M.

In addition, the fixing belt 363 is formed out of synthetic resin such as polyimide like an endless belt with an inner diameter of 30 mm and a thickness of 75 μm. A release layer made from PFA or the like is provided on the surface of the fixing belt 363 in accordance with necessity.

As shown in FIG. 10, the pressure contact member 365 is chiefly constituted by a not-shown belt housing made of synthetic resin, a belt frame 367 made from metal, a nip head member 368 and a pad member 369. The belt frame 367 has a substantially U-shape in section. The belt frame 367 is attached fittingly to the belt housing. The nip head member 368 is provided for bringing the fixing belt 363 into pressure contact with the heating roll 362. The pad member 369 is attached to the nip head member 368.

In addition, as shown in FIG. 10, the belt frame 367 is attached to an arm member 371 held swingably around a fulcrum 370. The fixing belt 363 is brought into pressure contact with the heating roll 362 with a predetermined pressure though the pressure contact member 365 by a spring 372 disposed in pressure contact with a front end portion of the arm member 371.

The pressure with which the fixing belt 363 is brought into pressure contact with the heating roll 362 may be changed by adjusting the amount of compression of the spring 372 or the like.

Figure 11:
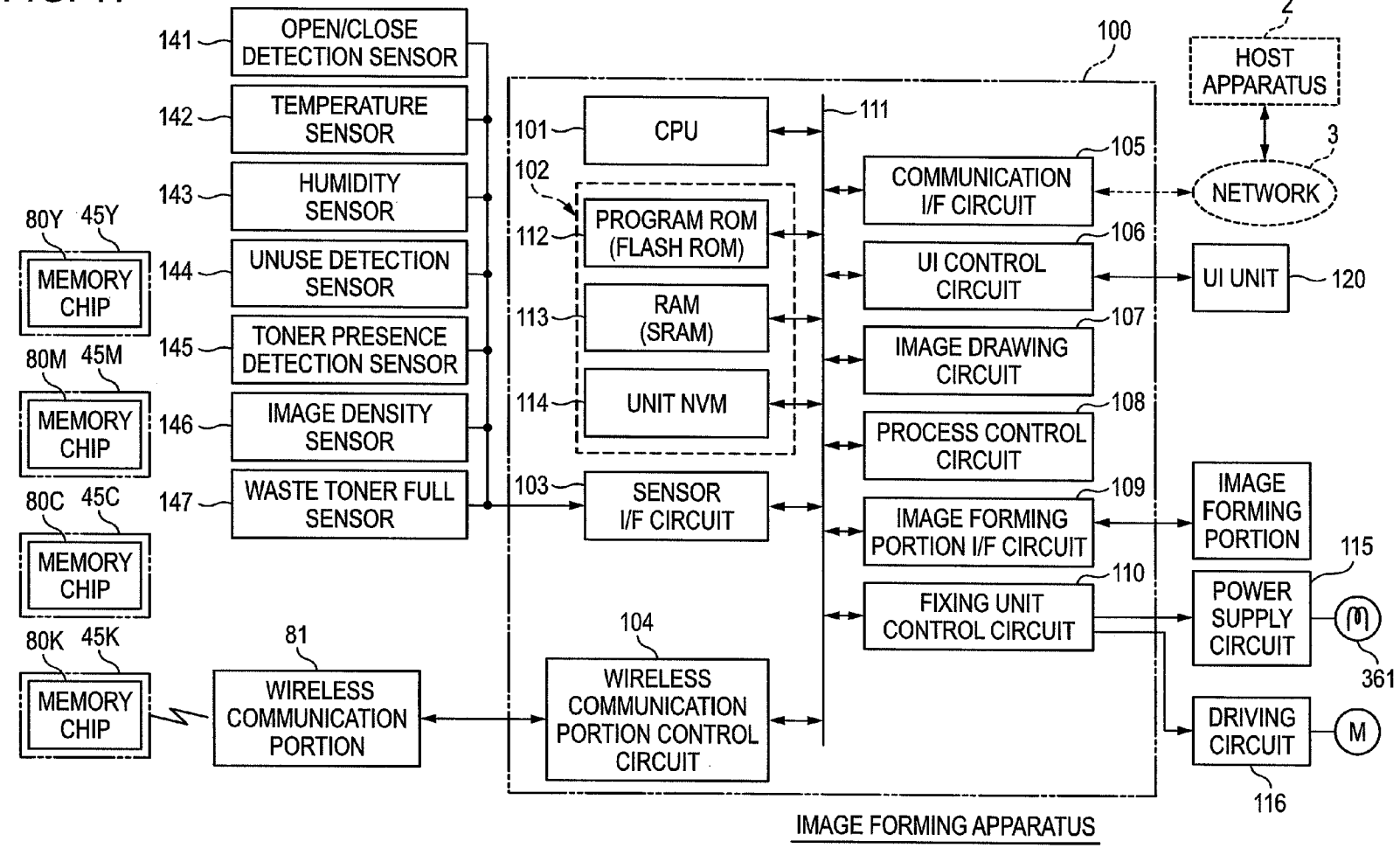
FIG. 11 is a sectional configuration view showing the developing agent cartridge.

FIG. 11 is a block diagram showing a control circuit of the full-color printer.

In FIG. 11, the reference numeral 100 represents a control circuit of the full-color printer. The control circuit 100 has a CPU 101, a storage portion 102, a sensor interface (sensor I/F) 103, a wireless communication control circuit 104, a communication interface (communication I/F) 105, a user interface (UI) control circuit 106, an image drawing circuit 107, a process control circuit 108, an image forming portion interface (image forming I/F) circuit 109, a fixing unit control circuit 110, etc. These parts of the control circuit 100 can input/output signals to each other through a system bus 111.

The CPU 101 transmits/receives signals to/from each part constituting the control circuit 100 through the system bus 111 so as to control each part constituting the control circuit 100. The CPU 101 also serves as a changing unit for changing fixing conditions.

In addition, the storage portion 102 has a program ROM 112, a RAM 113 and a unit NVM (Non-Volatile Memory) 114 so as to store information required for controlling the full-color printer 1. The program ROM 112 is, for example, constituted by a flash memory, which can update the contents stored therein. The RAM 113 is, for example, constituted by an SRAM, which stores temporary information such as drawing data supplied from the image drawing circuit 107. The unit NVM 114 is constituted by an electrically rewritable nonvolatile memory such as an EEPROM or a flash ROM. The unit NVM 114 may be a rewritable storage device such as an SRAM, an HDD (Hard Disk Drive) or an optical memory, which is backed up with power supply from a battery or the like so that data can be held even if the printer 1 is powered off.

The sensor I/F circuit 103 receives detection results from an open/close detection sensor 141, a temperature sensor 142, a humidity sensor 143, an unuse detection sensor 144, a toner presence detection sensor 145, an image density sensor 146 and a waste toner full sensor 147 respectively, and supplies the detection results to the CPU 101 through the system bus 111.

The wireless communication portion control circuit 104 transmits/receives signals to/from four memory chips 170 provided in the developing agent cartridges 45Y to 45K through a wireless communication portion 81, and transmits/receives signals to/from the CPU 101, the storage portion 102, etc. through the system bus 111, so as to connect the memory chips 170 with the CPU 101, the storage portion 102, etc.

The communication I/F circuit 105 transmits/receives signals to/from the host apparatus 2 through the network 3, and transmits/receives signals to/from the CPU 101 etc. through the system bus 111, so as to connect the host apparatus 2 with the CPU 101 etc. The UI control circuit 106 transmits/receives signals to/from a UI unit 120, and transmits/receives signals to/from the CPU 101 etc. through the system bus 111, so as to connect the UI unit 120 with the CPU 101 etc.

The image drawing circuit 107 draws an image based on an image forming signal supplied from the host apparatus 2 or the like, and supplies the image to the CPU 101 and the RAM 113. The process control circuit 108 together with the CPU 101 controls an image forming portion 230 including the exposure unit 7, the image forming unit 26, the developing unit 9, etc. through the image forming I/F circuit 109 with reference to set values etc. stored in the storage portion 102. The set values will be described later.

The fixing unit control circuit 110 controls at least one of the heating temperature and the moving speed of the fixing unit 36 through a power supply circuit 115 and a drive circuit 116 based on a signal from the CPU 101. The power supply circuit 115 controls a voltage applied to the halogen lamp 361 of the fixing unit 36. The drive circuit 116 drives the driving motor M for rotationally driving the fixing roll. In this exemplary embodiment, both the heating temperature and the moving speed of the fixing unit 36 can be controlled.

The CPU 101 can compare data stored in the storage portion 102 with data stored in the unit NVM 114 so as to determine the status of the developing agent cartridge 45 to which the memory chip 80 is attached. Therefore, the memory chip 80 forms a part of a detection unit though it has no sensor.

In addition, as shown in FIG. 11, the full-color printer 1 has the open/close detection sensor 141 for detecting whether the top cover 27 is opened or closed, the temperature sensor 142 for detecting the temperature inside the printer body 4, the humidity sensor 143 for detecting the humidity inside the printer body 4, the unuse detection sensor 144 for detecting whether the full-color printer 1 is used or unused, the toner presence detection sensor 145 for detecting whether toner is present or not, the image density sensor 146 for detecting the density of an image, and the waste toner full sensor 147 for detecting whether waste toner is full or not. Signals from these sensors are supplied to the CPU 101 through the sensor interface (sensor I/F) circuit 103.

Figure 1:
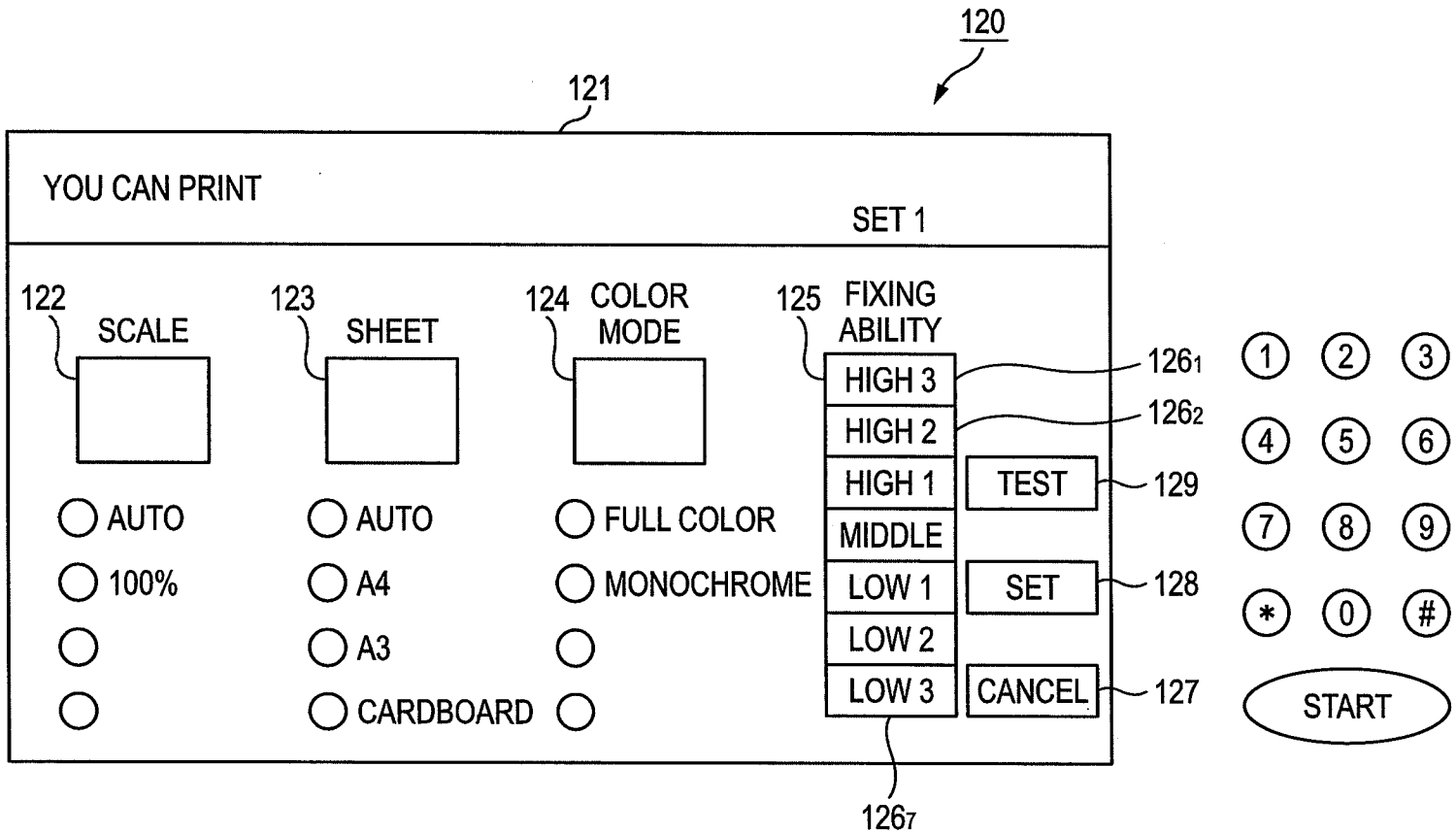
FIG. 1 is a configuration view showing a user interface unit of a full-color printer as an image forming apparatus according to a first exemplary embodiment of the invention.

FIG. 1 is a configuration view showing the UI unit 120.

As shown in FIG. 2, the UI unit 120 is constituted by a touch panel or the like, which includes a liquid crystal display unit provided in the surface of the top cover 27 of the full-color printer 1. As shown in FIG. 1, the UI unit 120 has a touch panel 121 provided with a liquid crystal display unit on which a user can push the screen by finger to select a desired item to be displayed. The touch panel 121 is provided with a scale selection portion 122 for selecting a scale factor, a sheet selection portion 123 for selecting a sheet, a color mode selection portion 124 for selecting a color mode, etc. In addition, a fixation setting portion 125 is provided in the touch panel 121. The fixation setting portion 125 serves as a setting unit for setting a plurality of levels of fixing condition in the fixing unit 36 in accordance with user's desire. When one of seven selection buttons $\mathbf{126}_1$ to $\mathbf{126}_7$ indicating high level 3, high level 2, high level 1, middle level, low level 1, low level 2, and low level 3 is pushed in the fixation setting portion 125, the level of the fixing condition desired by the user can be selected and set.

Figure 14:
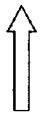
FIG. 14 is a view showing tables for setting fixing conditions.

In addition, as shown in FIG. 14, predetermined values for the heating temperature (fixing temperature) of the fixing unit 36 and the conveyance speed (fixing speed) of the recording sheet 12 have been stored in the unit NVM 114 in accordance with the kind of the recording medium such as normal paper, cardboard or OHP sheet in order to perform a fixing process with the level of the fixing condition desired by the user and corresponding to the selection button set by the fixing setting portion 125 from the seven selection buttons $\mathbf{126}_1$ to $\mathbf{126}_7$ indicating high level 3, high level 2, high level 1, middle level, low level 1, low level 2, and low level 3. For example, those values are stored based on a setting table for standard paper and a setting table for cardboard. In the table shown in FIG. 14, 15 levels from 1 to 15 are set as the fixing levels. Not to say, the fixing level may be set to correspond to all the 15 levels. However, as shown in FIG. 1, of the 15 fixing levels, seven fixing levels, for example, fixing level 3, fixing level 5, fixing level 7, fixing level 9, fixing level 11, fixing level 13 and fixing level 15 may be representatively selected and set. Further, the CPU 101 may make control to change the image forming speed of the apparatus as a whole in accordance with the fixing speed when the fixing speed is changed.

The fixation setting portion 125 may be designed not to set the level of fixing condition for high level 3, high level 2, high level 1, middle level, low level 1, low level 2, and low level 3 but to input 15 fixing levels or to directly set the values of the heating temperature of the fixing unit 36 and the conveyance speed of the recording sheet 12. In addition, the fixation setting portion 125 does not necessarily change both the heating temperature of the fixing unit 36 and the conveyance speed of the recording sheet 12, but may change either the heating temperature of the fixing unit 36 or the conveyance speed of the recording sheet 12. Alternatively, the fixation setting portion 125 may be designed to change the fixing pressure as well as the heating temperature of the fixing unit 36 and the conveyance speed of the recording sheet 12.

Figure 12:
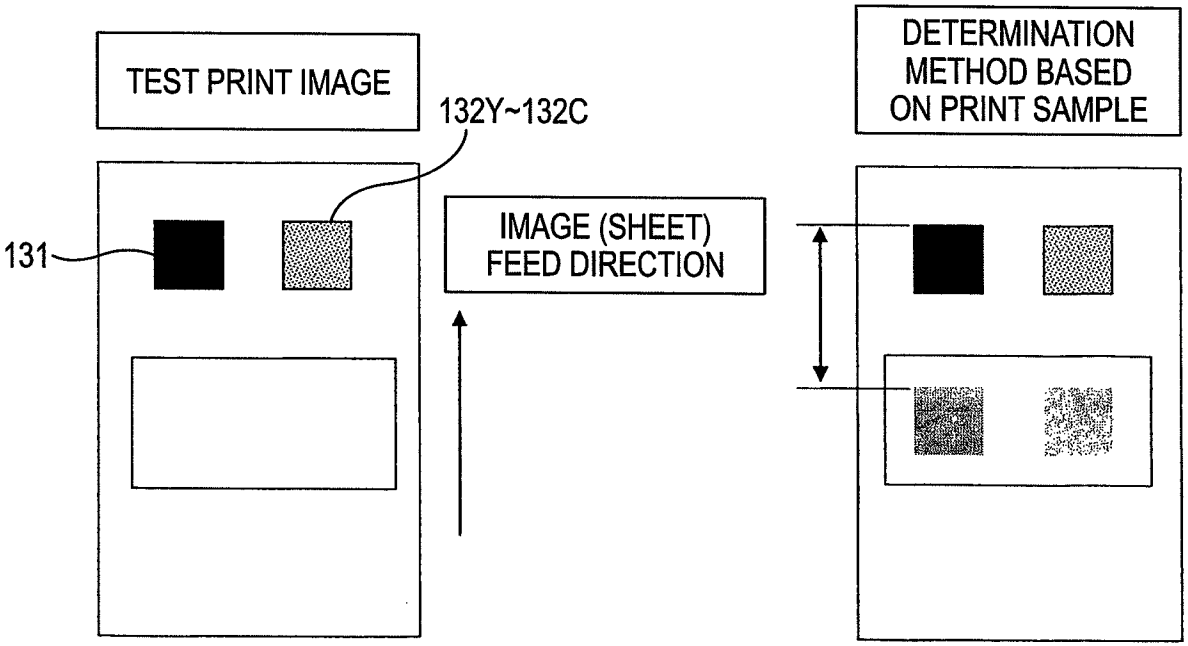
FIG. 12 is a schematic view showing a test chart.

In addition, as shown in FIG. 1, the fixation setting portion 125 is provided with a cancel button 127 for cancelling the function of the fixation setting portion 125, a setting button 128 for making the function of the fixation setting portion 125 effective, and a test button 129 for executing text fixing to fix predetermined test images 130, for example, onto a A4-size normal paper sheet, as shown in FIG. 12, in accordance with the level of fixing condition desired by the user.

For example, the test images 130 include a first test image 131 of process black formed out of toners of the respective colors (yellow (Y), magenta (M), cyan (C) and black (K)) with density of 100%, and second test images 132Y, 132M, 132C and 132K in which toner images of the respective colors (yellow (Y), magenta (M), cyan (C) and black (K)) are formed with half tone density of 30% respectively, as shown in FIG. 12. Since the first test image 131 is an image of process black formed out of toners of the respective colors (yellow (Y), magenta (M), cyan (C) and black (K)) with density of 100%, the amount of the toners to be fixed is so large that the image can be used for determining whether there occurs a fixing defect or not. When, for example, the first test image 131 is rubbed with a paper sheet, the presence of a fixing defect can be determined based on whether toner is separated or not.

In addition, the second test images 132Y, 132M, 132C and 132K are images in which toner images of the respective colors (yellow (Y), magenta (M), cyan (C) and black (K)) are formed with half tone density of 30% respectively. Particularly the images are used for determining whether a high-temperature offset has occurred in the fixing unit 36 or not. The degrees of brilliance in the second test images 132Y, 132M, 132C and 132K are observed visually so that the existence of occurrence of the high-temperature offset can be determined based on whether each second test images 132Y, 132M, 132C, 132K has an abnormal degree of brilliance or not.

Figure 13:
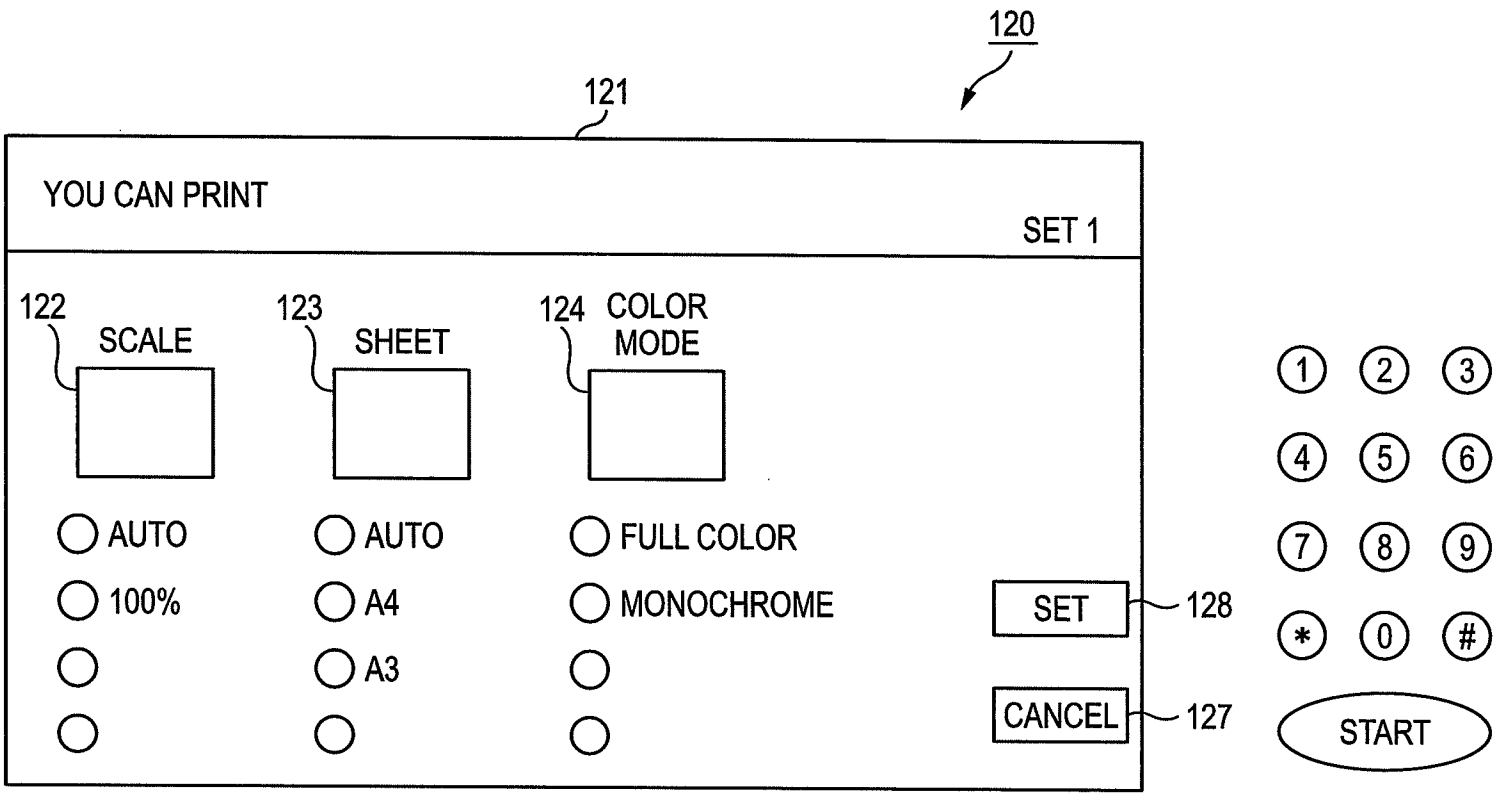
FIG. 13 is a configuration view showing a user interface unit.

Further, when the cancel button 127 is pushed on the touch panel 121, the seven selection buttons $\mathbf{126}_1$ to $\mathbf{126}_7$ and the test button 129 of the fixation setting portion 125 are removed from the screen as shown in FIG. 13. Thus, the user can be prevented from operating the fixation setting portion 125 by mistake to select and set another level of fixing condition though genuine toners are used in the full color printer.

On the other hand, when the setting button 128 is pushed on the touch panel 121, the seven selection buttons $\mathbf{126}_1$ to $\mathbf{126}_7$ and the test button 129 of the fixation setting portion 125 are displayed on the screen as shown in FIG. 1. Thus, the user is allowed to select and set any level of fixing condition.

With the aforementioned configuration, in the full-color printer as an image forming apparatus according to the exemplary embodiment, toner images fixed in accordance with the level of fixing condition desired by the user can be obtained in the following manner even if toners with unknown fixabilities are used.

In the full-color printer, a developing agent 52 of a predetermined color is supplied from each developing agent cartridge 45Y, 45M, 45C, 45K attached to each developing unit 8 to each corresponding developing unit 8Y, 8M, 8C, 8K as shown in FIGS. 2 and 7. Thus, an operation is made to print a color image.

Not to say, the developing agent cartridges 45 are provided by the manufacturer of the full-color printer. However, developing agent cartridges applied to the full-color printer may be manufactured and sold by another manufacturer than the manufacturer of the full-color printer.

In the full-color printer, as shown in FIG. 2, various images including full-color, monochrome, unicolor or bicolor images can be formed out of toners of the respective colors (yellow (Y), magenta (M), cyan (C) and black (K)). On that occasion, in the fixing unit of the full-color printer, the fixing conditions including the heating temperature of the recording sheet, the conveyance speed of the recording sheet, the pressure of contact between the heating roll and the fixing belt, etc. are set in accordance with the physical properties of genuine toners in the developing agent cartridges 45 provided by the manufacturer of the printer. As long as the genuine toners are used, high-quality images can be obtained even if the kind of recording sheet as a recording medium or environmental conditions such as temperature, humidity, etc. are changed.

In the full-color printer, however, a developing agent cartridge provided by another manufacturer than the manufacturer of the printer may be attached and used. In this case, the physical properties (melting point etc.) of toner in the developing agent cartridge may differ from the physical properties (melting point etc.) of toner set in advance by the manufacturer of the printer. Thus, there is a fear that the fixability set in advance in the printer cannot be obtained. As a result, a toner image may be fixed insufficiently, or a high-temperature offset etc. may occur to generate a fixing defect.

According to this exemplary embodiment, as shown in FIG. 1, therefore, a user can operate the UI unit 120 to carry out a fixing process in accordance with the level of fixing condition desired by the user even if toner with unknown fixability is used.

For the printing operation, the user operates the UI unit 120 of the full-color printer or operates the host apparatus 2 such as a personal computer in which a printer driver or the like for executing the printing operation in the full-color printer has been installed. Thus, an input screen for the printing operation is displayed to allow the user to input the size or kind of recording sheet for printing, the number of prints, etc.

On that occasion, in the UI unit 120 of the full-color printer, as shown in FIG. 1, the user can push any one of the seven selection buttons $\mathbf{126}_1$ to $\mathbf{126}_7$ of high level 3, high level 2, high level 1, middle level, low level 1, low level 2, and low level 3 provided in the fixation setting portion 125, so as to select and set the level of fixing condition desired by the user. In this case, due to the test button 129 provided in the UI unit 120, test fixing for beforehand checking the fixability of toner to the recording sheet 26 specified by the user can be performed using the predetermined test images 130 as shown in FIG. 12.

In this test fixing, as shown in FIG. 2, developing agents of the respective colors (yellow (Y), magenta (M), cyan (C) and black (K)) containing at least toners are supplied from the developing agent cartridges attached to the full-color printer 1. Using the toners of the respective colors, the test fixing is carried out. That is, as shown in FIG. 12, the first test image 131 of process black in which toners of the respective color (yellow (Y), magenta (M), cyan (C) and black (K)) are superimposed with density of 100%, and the second test images 132Y, 132M, 132C and 132K in which toners of the respective colors (yellow (Y), magenta (M), cyan (C) and black (K)) are formed with half tone density of 30% respectively are formed on the sheet 12. The position that it is likely to dirty by an offset of a test image is displayed in advance into the rectangle frame on the sheet 12 so as to test whether this frame is dirty. When the images in the sheet are examined, the fixability may be checked easily.

The user can determine the fixability of the toners based on the first test image 131 and the second test images 132Y, 132M, 132C and 132K and operate the seven selection buttons $\mathbf{126}_1$ to $\mathbf{126}_7$ of high level 3, high level 2, high level 1, middle level, low level 1, low level 2, and low level 3 provided in the fixation setting portion 125, so as to obtain the fixing condition desired by the user. Thus, fixation can be carried out in accordance with the level of fixing condition desired by the user.

Next, the operation of the full-color printer according to the exemplary embodiment will be described in detail with reference to the drawings.

Figure 15:
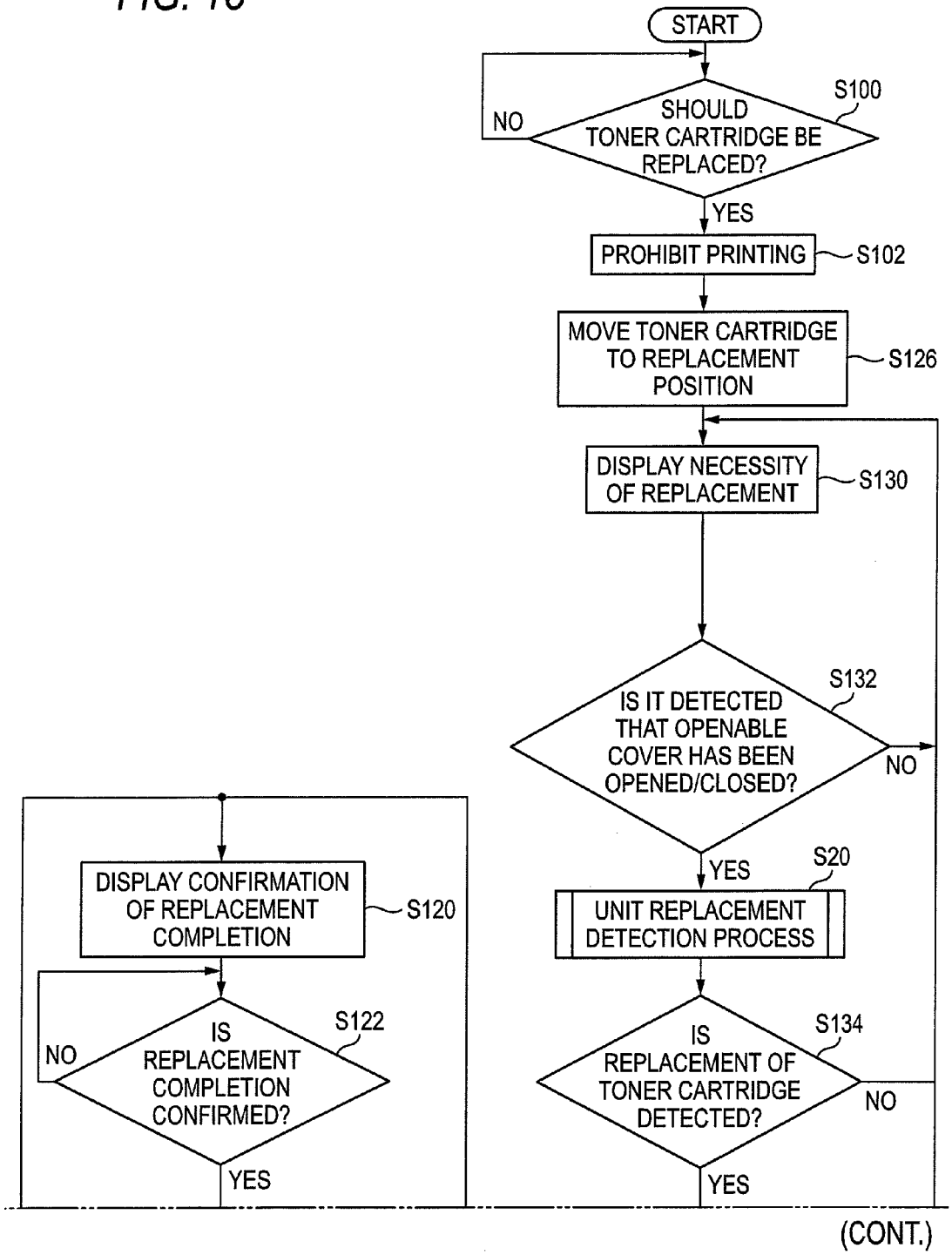
FIG. 15 is a flow chart showing the operation of the full-color printer.

As shown in FIG. 15, the CPU 101 first determines whether one of toner cartridges 45 should be replaced or not (Step 100). Here, whether one of toner cartridges 45 should be replaced or not can be, for example, determined by whether the image density formed on the intermediate transfer belt 10 is below a predetermined level or not, whether the toner density in the developing unit 8 is below a predetermined level or not, or whether the absence of toner is detected by a not-shown toner presence detection sensor or not. The CPU 101 determines that toner is absent from the toner cartridge 45 and judges that the toner cartridge 45 should be replaced. When the CPU 101 concludes that the toner cartridge 45 should be replaced, the CPU 101 forbids printing (Step 102). When the toner cartridge 45 does not have to be replaced, the CPU 101 continuously checks whether the toner cartridge 45 should be replaced or not till there occurs necessity that the toner cartridge 45 should be replaced.

When the CPU 101 determines that toner is absent from the toner cartridge 45, the CPU 101 forbids printing with the color printer (Step S102).

In Step 128, the control portion 100 rotates the developing unit body 40 in accordance with user's input on the UI unit 120 or the like, so as to move a to-be-replaced toner cartridge 45 to a replacement position.

Figure 20A:
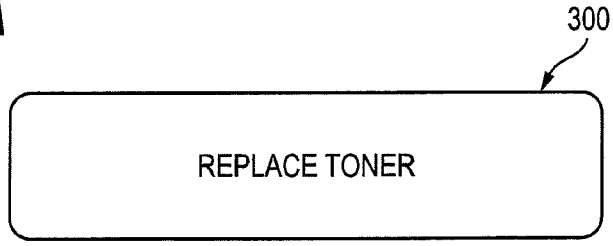
FIGS. 20A to 20D are explanatory views showing a display of the user interface unit.
Figure 20B:
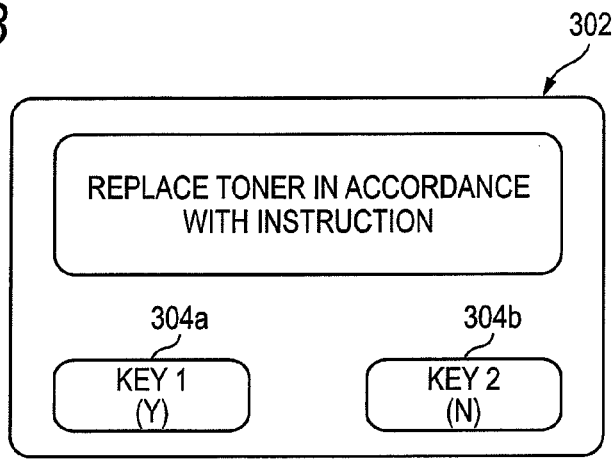
Figure 20C:
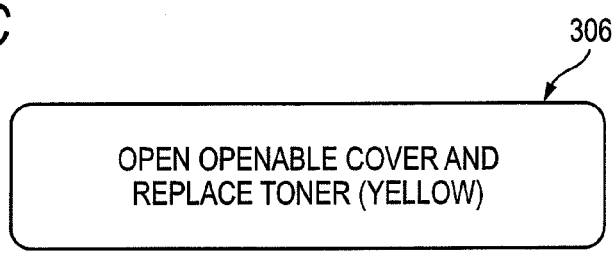

In Step 130, the UI unit 120 displays a replacement necessity display screen 300 shown in FIG. 20A.

In Step 132, the CPU 101 makes the open/close detection sensor 141 detect whether the openable cover 27 has been opened/closed or not. When it is detected that the openable cover 27 is opened/closed, the processing flow returns to the processing of Step 120. When it is not detected that the openable cover 27 is opened/closed, the processing flow returns to the processing of Step 130.

Figure 16:
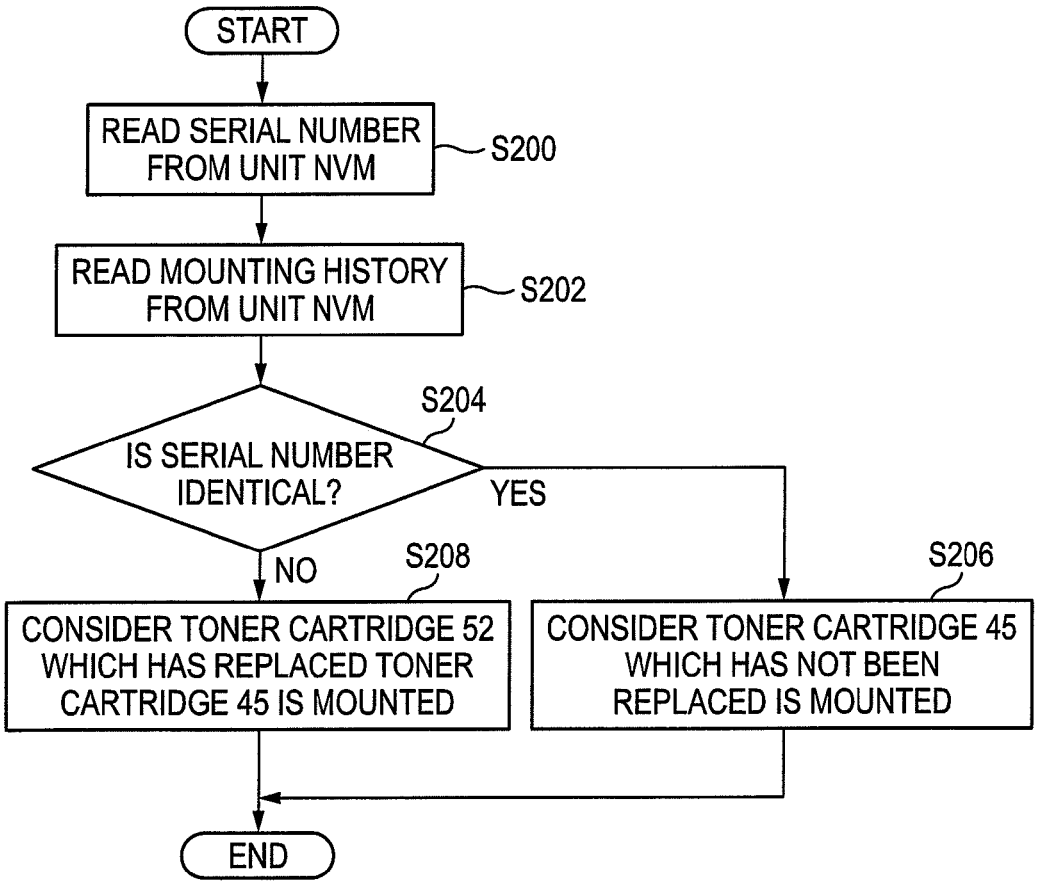
FIG. 16 is a flow chart showing the operation of the full-color printer.

In Step 200 (see FIG. 16), the CPU 101 reads a serial number from the unit NVM 114. In Step 202, the CPU 101 reads a serial number of a last mounted one of toner cartridges included in the mounting history of each unit in the unit NVM 114.

In Step 204, the CPU 101 determines whether the serial number of the last mounted toner cartridge coincides with the serial number read from the unit NVM 114 or not. When the serial number of the last mounted toner cartridge coincides with the serial number read from the unit NVM 114, the processing flow advances to processing of Step 206. Otherwise the processing flow advances to processing of Step 208.

In Step 206, the CPU 101 considers that the toner cartridge 45 which has not been replaced is mounted again (has not been replaced).

In Step 208, the CPU 101 considers that a toner cartridge 52 which has replaced the toner cartridge 45 is mounted (replacement has been detected).

In Step 134 (see FIG. 15), the CPU 101 determines whether replacement of the toner cartridge 45 has been detected or not based on the unit replacement detection process (S20). When it is concluded that the replacement of the toner cartridge 45 has been detected, the processing flow advances to processing of Step 104. Otherwise the processing flow returns to the processing of Step 130.

After that, the CPU 101 checks whether signals can be transmitted/received (communication can be established) between the toner cartridge 45 and the memory chip 80 through the wireless communication portion 81 or not (Step 104). When the CPU 101 concludes that communication cannot be established, the CPU 101 determines that the toner cartridge 45 is a non genuine product, the processing flow advances to processing of Step 120. When communication can be established, the CPU 101 reads a model code and a country code from the unit NVM 114.

Next, the CPU 101 checks the model code with a model code supported by the printer and checks the country code with a country supported by the printer. When it is concluded that the replaced toner cartridge 45 is a genuine product, the processing flow advances to processing of Step 400. On the contrary, when it is concluded that the replaced toner cartridge 45 is a non genuine product, the processing flow advances to processing of Step 120.

Figure 20D:
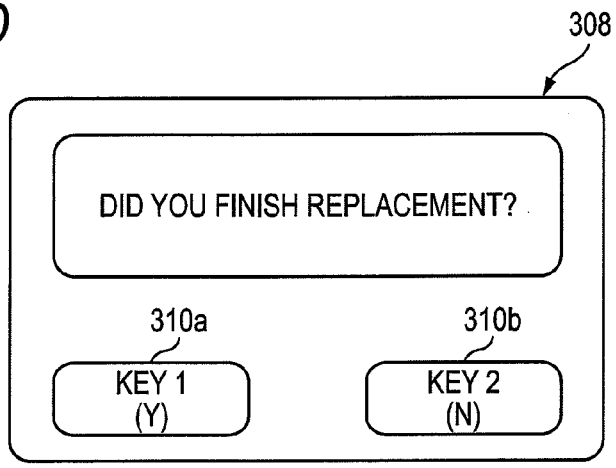

The UI unit 120 displays a replacement completion screen 308 shown in FIG. 20D (Step 120). On the replacement completion screen 308, the fact that the toner cartridge 45 has been replaced can be accepted by user's input on a key button 310*a*, and the fact that the toner cartridge 45 has not been replaced is accepted by user's input on a key button 310*b*.

The CPU 101 determines whether the toner cartridge 45 has been replaced or not based on user's input on the replacement completion screen 308 (Step 122). When it is concluded that the toner cartridge 45 has been replaced, the processing flow advances to processing of Step 30. When it is concluded that the toner cartridge 45 has not been replaced, the CPU 101 waits till the user gives an input indicating replacement confirmation (Step 122). That is, the CPU 101 regards the toner cartridge 45 as replaced, due to the processing from Step 112 to Step 122.

Figure 21A:
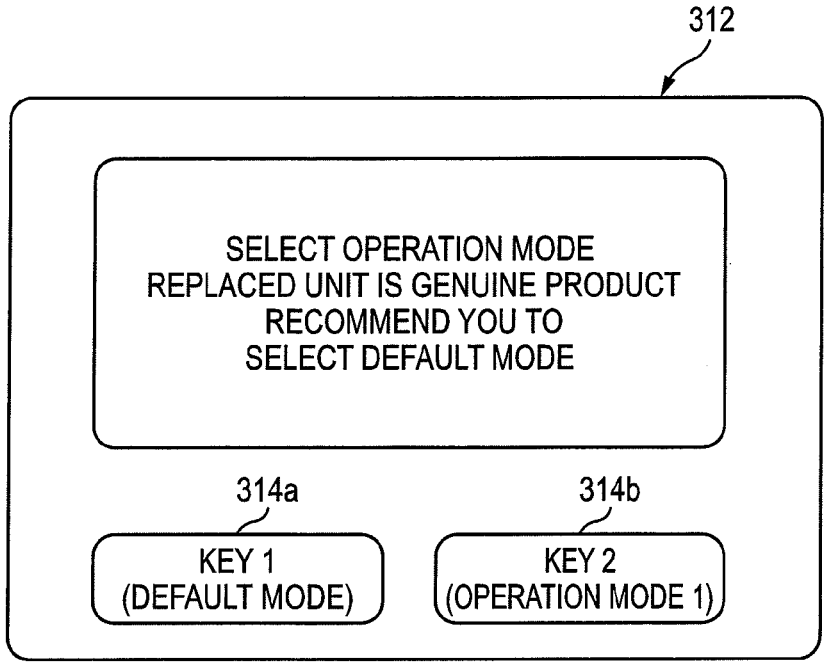
FIGS. 21A and 21B are explanatory views showing a display of the user interface unit.
Figure 21B:
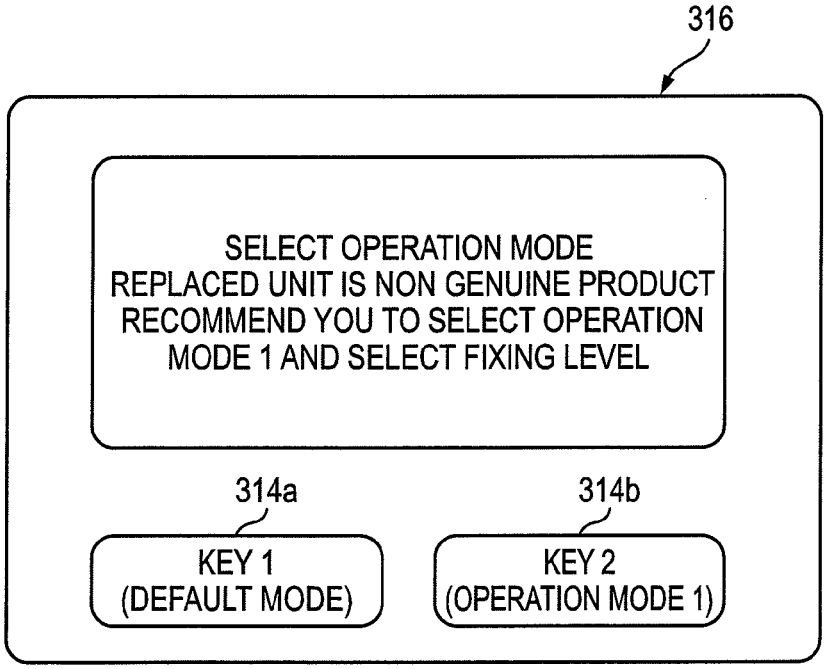

In Step 300 (see FIG. 17), the UI unit 120 displays an operation mode selection screen 316 shown in FIG. 21B.

In Step 302, the CPU 101 determines whether an input has been given to select one of key buttons 314*a* and 314*b* displayed on the operation mode selection screen 316 or not. The key button 314*a* is provided for selecting a default mode (operation mode corresponding to a genuine product). The key button 314*b* is provided for specifying another operation mode. When an input has been given to select one of the key buttons 314*a* and 314*b*, the processing flow advances to processing of Step 304. When no input has been given to designate one of the operation modes, the color printer waits till the user selects an operation mode.

The CPU 101 updates each operation mode history (including overwriting of the same information) in the unit NVM 114 with the operation mode selected in Step 302 (Step 304).

Figure 17:
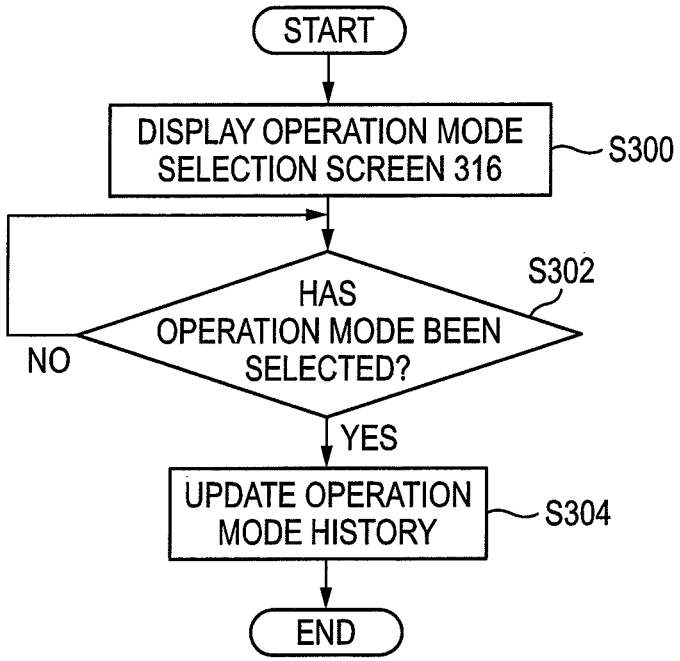
FIG. 17 is a flow chart showing the operation of the full-color printer.

On that occasion, when the CPU 101 concludes that the toner cartridge 45 is a non genuine product, in Step 300, the CPU 101 displays an operation mode selection screen 316 on the UI unit 120 as shown in FIG. 21B to urge the user to select an operation mode 1 and select a fixing level, as shown in FIG. 17.

Figure 22:
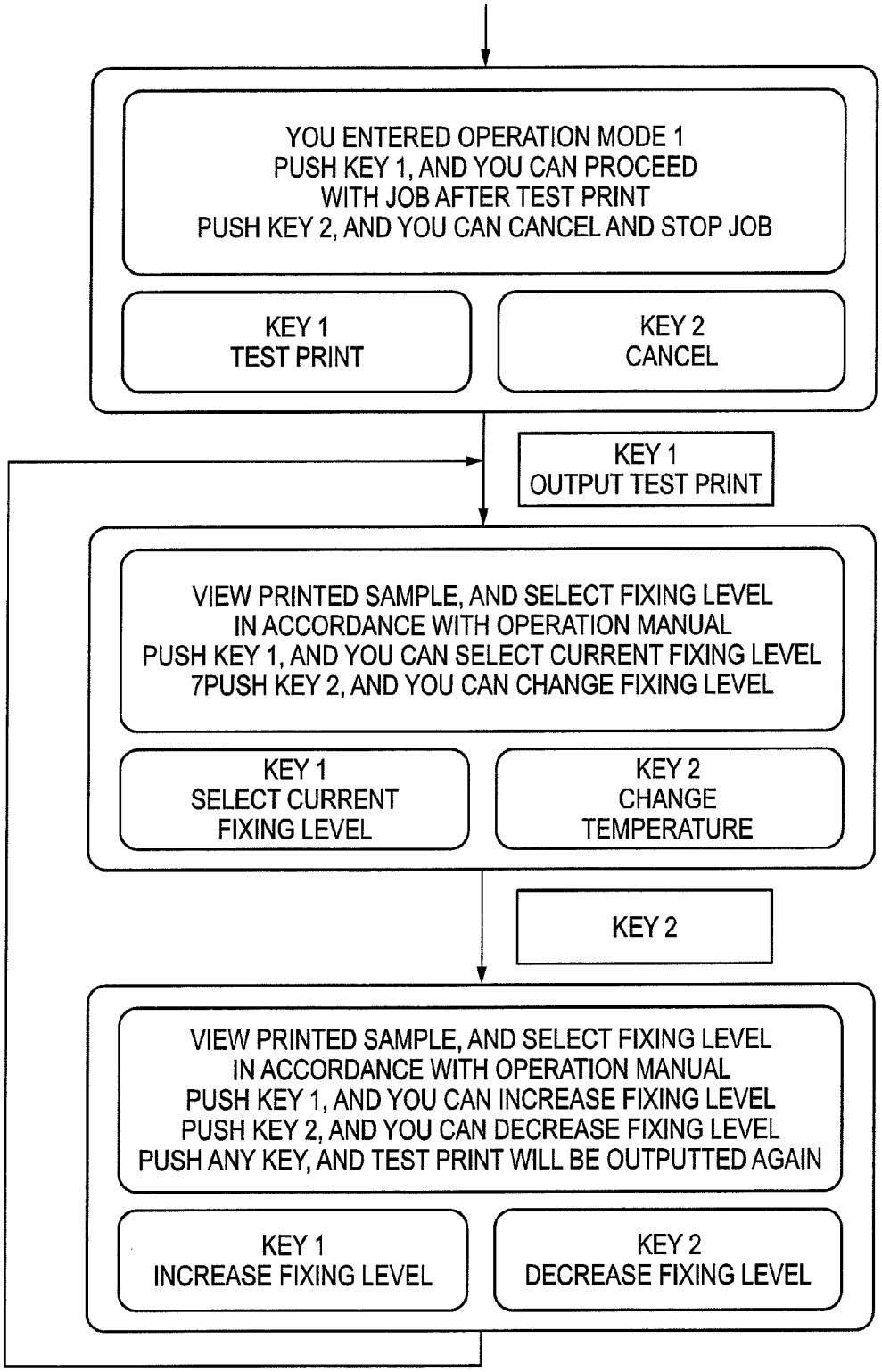
FIG. 22 is an explanatory view showing a display and an operation of the user interface unit.

Here, when the user selects the key button 314*b*, the CPU 101 executes the operation mode 1 as shown in FIG. 22. That is, as shown in FIG. 22, the CPU 101 displays a message indicating "Push key 1 to proceed with job after test printing, or push key 2 to cancel the test printing and cease the job" on the UI unit 120. When the user pushes the key 1 to select to proceed with job after test printing, the CPU 101 outputs a test print as shown in FIG. 12. On the other hand, when the key 2 is pushed, the CPU 101 sets a default fixing level and terminates the operation for setting the fixing level.

Then, as shown in FIG. 22, the CPU 101 displays a message indicating "View printed samples and select a fixing level in accordance with operation manual" and a message such as "Push key 1 to select the current fixing level, or push key 2 to change the fixing level" on the UI unit 120. When the key 1 is pushed, the CPU 101 sets the current fixing level and terminates the operation for setting the fixing level.

When the user pushes the key 2 to select to change the fixing level, the CPU 101 displays on the UI unit 120 a message indicating "View printed sample and select fixing level in accordance with operation manual" and a message indicating "Push key 1 if you want to increase fixing level, and push key 2 if you want to decrease fixing level" or "Push any key, and a test print will be outputted again", as shown in FIG. 22. Here, in the fixing level selection method described in the operation manual, for example, Step 1 suggests that if an image on a test sample as shown in FIG. 12 is rubbed with tissue paper or the like and the tissue paper is contaminated, the fixing level should be increased because the fixing level is too low. On the other hand, Step 2 suggests that if the tissue paper with which the image on the test sample is rubbed is not contaminated but dirty appears near the image on the test sample as shown in FIG. 12, the fixing level should be decreased because the fixing level is too high. When Steps 1 and 2 are not compatible with each other, Step 3 recommends the user to select a fixing level with which both the degree of dirty in Step 1 and the degree of dirty in Step 2 can be minimized.

When the user then pushes the key 1 to select to decrease the fixing level, the CPU 101 makes control to decrease the fixing level by only one step based on a table shown in FIG. 14. When the user pushes the key 2 to select to increase the fixing level, the CPU 101 makes control to increase the fixing level by only one step based on the table shown in FIG. 14. After making control to change the fixing level, the CPU 101 outputs the test print created again in accordance with the changed fixing level as shown in FIG. 12.

Figure 19:
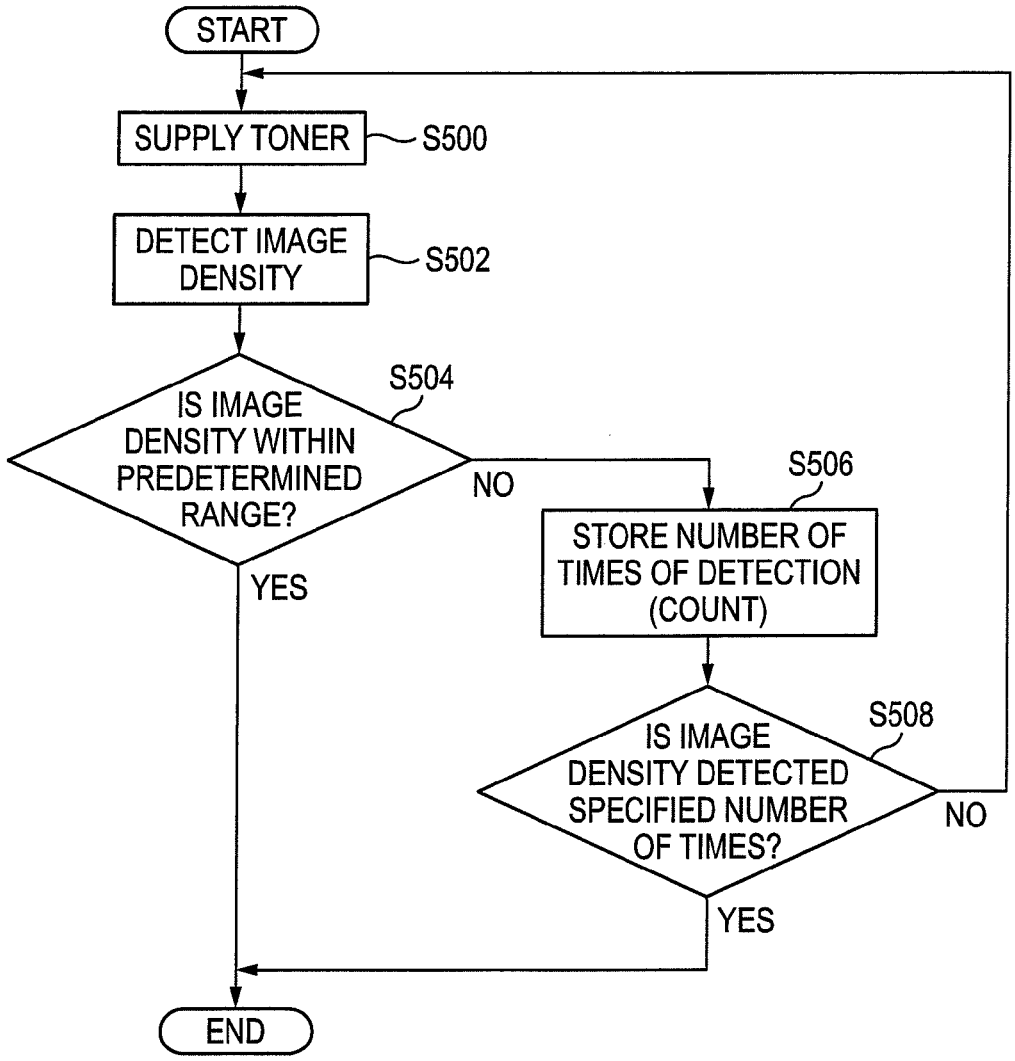
FIG. 19 is a flow chart showing the operation of the full-color printer.

In addition, as shown in FIG. 19, the control portion 100 allows the auger 58 in the toner cartridge 45 to rotate in accordance with the selected operation mode so as to supply toner from the toner cartridge 45 to the developing unit 8 (Step 500).

The CPU 101 makes the image density sensor 28 detect the image density of a patch formed on the intermediate transfer belt 10 (Step 502).

After that, the CPU 101 determines whether the detected image density is within a predetermined range or not (Step 504). When the image density is within the predetermined range, the processing is terminated. When the image density is not within the predetermined range, the processing flow advances processing of Step 506.

In Step 506, the CPU 101 stores the number of times (counts) of detection of image density, for example, in the RAM 113 or the like as shown in FIG. 11.

Further, the CPU 101 determines whether the image density has been detected a specified number of times or not (Step 508). When the image density has been detected a specified number, the processing is terminated. When the image density has not been detected a specified number, the processing flow returns to the processing of Step 500.

In addition, as shown in FIG. 15, the CPU 101 determines whether the adjustment of the image density in the image density adjustment process (S50) has been normally finished or not (Step 124). When the adjustment of the image density has been normally finished, for example, when the image density is within the predetermined range, the processing flow advances to processing of Step 126. When the adjustment of the image density has not been normally finished, the processing flow returns to the processing of Step 112.

In Step 126, the CPU 101 resets (initializes) a life count value stored as each body-side life count value correspondingly to each replaced toner cartridge 45.

Figure 18:
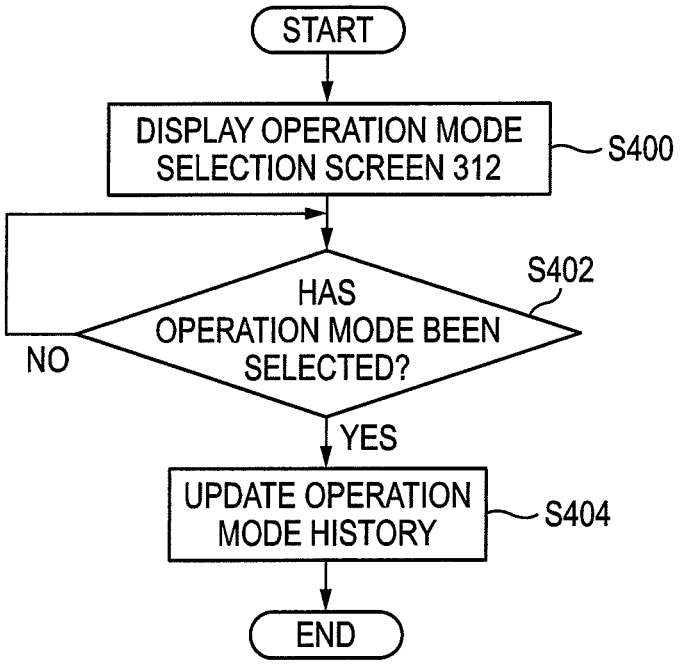
FIG. 18 is a flow chart showing the operation of the full-color printer.

In Step 400 (see FIG. 18), the UI unit 120 displays an operation mode selection screen 312 shown in FIG. 21A.

In Step 402, the CPU 101 determines whether an input to select any one of a key button 314*a* for selecting a default mode (operation mode supporting genuine products) and a key button 314*b* for specifying any one of operation modes which key buttons 314*a* and 314*b* are displayed on the operation mode selection screen 312 has been received or not. When the input to select one of the key buttons 314*a* and 314*b* has been made, the processing flow advances to processing of Step 404. When no input for specifying any one of operation modes has been made, the image forming unit 26 waits till the user selects an operation mode.

In Step 404, the CPU 101 updates (or including overwriting with the same information) each operation mode history in the unit NVM 114 with the operation mode selected in Step 402.

In Step 136 (see FIG. 15), the CPU 101 makes printing preparation in accordance with the selected operation mode included in each latest operation mode history, and terminates the processing. In the printing preparation in Step 136, for example, whether the mounted toner cartridge 45 is a genuine product or a non genuine product may be displayed on the UI unit 120.

Plural of other operation modes different from the operation mode supporting genuine products may be provided. In this design, the user can desirably select an operation mode from the other operation modes.

In this manner, when a replaceable unit of the color printer is a non genuine product, the user can select an operation mode different from the operation mode supporting genuine products, so as to improve the image quality.

When all the replaceable units are genuine products, the operation mode the user can select may be limited to allow the color printer to operate only in the operation mode supporting the genuine products to prevent the user from lowering the image quality by mistake.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

a fixing unit which fixes an unfixed toner image retained onto a recording medium by at least heat while moving the recording medium;

a setting unit which sets a plurality of levels of fixing condition in the fixing unit in accordance with user's desire;

a changing unit which changes at least one of temperature with which the recording medium is heated by the fixing unit and speed with which the recording medium is moved by the fixing unit, in accordance with the level of fixing condition set by the setting unit; and an input unit which displays image forming conditions and specifies ones from the displayed image forming conditions so as to input the specified image forming conditions; wherein:

only when the setting unit is specified by the input unit, setting items of the setting unit are displayed as ones of the image forming conditions of the input unit.

2. The image forming apparatus according to claim 1, wherein the setting unit has a fixability checking function in which the setting unit allows the fixing unit to fix a predetermined unfixed toner image retained onto a recording medium, using at least one of the temperature with which the recording medium is heated by the fixing unit and the speed with which the recording medium is moved by the fixing unit, the heating temperature and the moving speed having been changed by the changing unit in accordance with the level of fixing condition set by the setting unit.

3. The image forming apparatus according to claim 1, further comprising:

a cancel unit which cancels a function by which the setting unit is displayed as one of the image forming conditions of the input unit.

4. The image forming apparatus according to claim 3, further comprising:

an activating unit which activates the cancel unit to display the cancel unit as one of the image forming conditions of the input unit.

5. The image forming apparatus according to claim 1, wherein:

the setting unit has a function of cancelling an operation of displaying the setting unit as one of the image forming conditions of the input unit, as one of the setting items of the setting unit.

6. The image forming apparatus according to claim 1, wherein an adjusting range of the temperature with which the recording medium is heated by the fixing unit or the speed with which the recording medium is moved by the fixing unit according to the changing unit is set in a way that a range to increase the temperature is larger than that to reduce the temperature or a range to reduce the speed is larger than that to increase the speed.

7. An image forming apparatus comprising:

a fixing unit which fixes an unfixed toner image retained onto a recording medium by at least heat while moving the recording medium;

a setting unit which sets a plurality of levels of fixing condition in the fixing unit in accordance with user's desire;

a changing unit which changes at least one of temperature with which the recording medium is heated by the fixing unit and speed with which the recording medium is moved by the fixing unit, in accordance with the level of fixing condition set by the setting unit; and a toner replacement detection unit which detects replacement of toner for use in the image forming apparatus; wherein:

the setting unit is made available when the replacement of toner is detected by the toner replacement detection unit.

8. An image forming apparatus comprising:

a fixing unit which fixes an unfixed toner image retained onto a recording medium by at least heat while moving the recording medium;

a setting unit which sets a plurality of levels of fixing condition in the fixing unit in accordance with user's desire;

a changing unit which changes at least one of temperature with which the recording medium is heated by the fixing unit and speed with which the recording medium is moved by the fixing unit, in accordance with the level of fixing condition set by the setting unit; and a genuine toner determination unit which determines whether toner used in the image forming apparatus is a genuine toner or not; wherein:

only when the genuine toner determination unit concludes that the toner used in the image forming apparatus is not a genuine toner, the setting unit is made available.

9. An image forming apparatus comprising:

a fixing unit which fixes an unfixed toner image retained onto a recording medium by at least heat while moving the recording medium;

a setting unit which sets a plurality of levels of fixing condition in the fixing unit in accordance with user's desire when toner fixability with which the toner image is formed is different from toner fixability set in advance in the fixing unit;

a changing unit which changes at least one of temperature with which the recording medium is heated by the fixing unit and speed with which the recording medium is moved by the fixing unit, in accordance with the level of fixing condition set by the setting unit; and an input unit which displays image forming conditions and specifies ones from the displayed image forming conditions so as to input the specified image forming conditions; wherein:

only when the setting unit is specified by the input unit, setting items of the setting unit are displayed as ones of the image forming conditions of the input unit.

10. The image forming apparatus according to claim 9, wherein the setting unit has a fixability checking function in which the setting unit allows the fixing unit to fix a predetermined unfixed toner image retained onto a recording medium, using at least one of the temperature with which the recording medium is heated by the fixing unit and the speed with which the recording medium is moved by the fixing unit, the heating temperature and the moving speed having been changed by the changing unit in accordance with the level of fixing condition set by the setting unit.

11. The image forming apparatus according to claim 9, further comprising:

a cancel unit which cancels a function by which the setting unit is displayed as one of the image forming conditions of the input unit.

12. The image forming apparatus according to claim 11, further comprising:

an activating unit which activates the cancel unit to display the cancel unit as one of the image forming conditions of the input unit.

13. The image forming apparatus according to claim 9, wherein:

the setting unit has a function of cancelling an operation of displaying the setting unit as one of the image forming conditions of the input unit, as one of the setting items of the setting unit.

14. The image forming apparatus according to claim 9, wherein an adjusting range of the temperature with which the recording medium is heated by the fixing unit or the speed with which the recording medium is moved by the fixing unit according to the changing unit is set in a way that a range to increase the temperature is larger than that to reduce the temperature or a range to reduce the speed is larger than that to increase the speed.

15. An image forming apparatus comprising:

a fixing unit which fixes an unfixed toner image retained onto a recording medium by at least heat while moving the recording medium;

a setting unit which sets a plurality of levels of fixing condition in the fixing unit in accordance with user's desire when toner fixability with which the toner image is formed is different from toner fixability set in advance in the fixing unit;

a changing unit which changes at least one of temperature with which the recording medium is heated by the fixing unit and speed with which the recording medium is moved by the fixing unit, in accordance with the level of fixing condition set by the setting unit; and a toner replacement detection unit which detects replacement of toner for use in the image forming apparatus; wherein:

the setting unit is made available when the replacement of toner is detected by the toner replacement detection unit.

16. An image forming apparatus comprising:

a fixing unit which fixes an unfixed toner image retained onto a recording medium by at least heat while moving the recording medium;

a setting unit which sets a plurality of levels of fixing condition in the fixing unit in accordance with user's desire when toner fixability with which the toner image is formed is different from toner fixability set in advance in the fixing unit;

a changing unit which changes at least one of temperature with which the recording medium is heated by the fixing unit and speed with which the recording medium is moved by the fixing unit, in accordance with the level of fixing condition set by the setting unit; and a genuine toner determination unit which determines whether toner used in the image forming apparatus is a genuine toner or not; wherein:

only when the genuine toner determination unit concludes that the toner used in the image forming apparatus is not a genuine toner, the setting unit is made available.

* * * * *